US011502393B2

(12) United States Patent
Park et al.

(10) Patent No.: US 11,502,393 B2
(45) Date of Patent: Nov. 15, 2022

(54) ANTENNA AND ELECTRONIC DEVICE INCLUDING THE SAME

(71) Applicant: SAMSUNG ELECTRONICS CO., LTD., Suwon-si (KR)

(72) Inventors: Seongjin Park, Suwon-si (KR); Dongyeon Kim, Suwon-si (KR); Hosaeng Kim, Suwon-si (KR); Sumin Yun, Suwon-si (KR); Woomin Jang, Suwon-si (KR); Myunghun Jeong, Suwon-si (KR); Jehun Jong, Suwon-si (KR); Jaehoon Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 182 days.

(21) Appl. No.: 17/096,036

(22) Filed: Nov. 12, 2020

(65) Prior Publication Data

US 2021/0151860 A1 May 20, 2021

(30) Foreign Application Priority Data

Nov. 18, 2019 (KR) ..... 10-2019-0147886

(51) Int. Cl.

| | |
|---|---|
| ***H01Q 1/24*** | (2006.01) |
| ***H01Q 1/38*** | (2006.01) |
| ***H01Q 21/06*** | (2006.01) |
| ***H01Q 9/04*** | (2006.01) |

(52) U.S. Cl.

CPC ..... *H01Q 1/243* (2013.01); *H01Q 1/38* (2013.01); *H01Q 9/045* (2013.01); *H01Q 9/0478* (2013.01); *H01Q 21/065* (2013.01)

(58) Field of Classification Search

CPC ..... H01Q 1/243; H01Q 1/38; H01Q 9/045; H01Q 9/0478; H01Q 21/065;

(Continued)

(56) References Cited

U.S. PATENT DOCUMENTS 7,605,758 B2 10/2009 Lazar
2001/0020920 A1* 9/2001 Shigihara ..... H01Q 9/0428 343/732

(Continued)

FOREIGN PATENT DOCUMENTS

| | | |
|---|---|---|
| CN | 105789886 | 7/2016 |
| JP | 2004-007038 | 1/2004 |

OTHER PUBLICATIONS

International Search Report dated Feb. 25, 2021 in counterpart International Patent Application No. PCT/KR2020/0015846.

*Primary Examiner* — Dimary S Lopez Cruz
*Assistant Examiner* — Michael M Bouizza
(74) *Attorney, Agent, or Firm* — Nixon & Vanderhye, P.C.

(57) ABSTRACT

Provided is an electronic device. The electronic device may include: a housing; and an antenna structure disposed in an internal space of the housing, wherein the antenna structure may include: a printed circuit board including a plurality of insulating layers; and at least one first conductive patch disposed on the printed circuit board, wherein the at least one first conductive patch may include: a first side having a first length; a second side parallel to the first side, spaced apart in a direction perpendicular to the first side, and having a second length shorter than the first length; a third side extending from one end of the first side in a direction perpendicular to the first side, and having a third length shorter than a vertical distance between the first side and the second side; a fourth side extending from an other end of the first side in a direction perpendicular to the first side, and having the third length; a fifth side connecting the third side and one end of the second side in a straight line; a sixth side connecting the fourth side and an other end of the second side in a straight line; a first feeding point disposed on a first virtual line passing through a center in the at least one first (Continued)

conductive patch and configured to transmit and/or receive a first signal of a first polarization; and a second feeding point disposed on a second virtual line passing through the center in the at least one first conductive patch and intersecting the first virtual line at a right angle and configured to transmit and/or receive a second signal of a second polarization perpendicular to the first polarization.

20 Claims, 28 Drawing Sheets

(58) Field of Classification Search
CPC ..... H01Q 9/0414; H01Q 21/24; H01Q 1/523; H01Q 9/0407; H01Q 1/2283; H01Q 1/46; H01Q 5/20; H01Q 9/0428
See application file for complete search history.

(56) References Cited

U.S. PATENT DOCUMENTS

| | | | | |
|---|---|---|---|---|
| 2003/0063031 | A1 | 4/2003 | Wong et al. | |
| 2008/0238781 | A1* | 10/2008 | Su | H01Q 9/0428 343/700 MS |
| 2016/0118720 | A1 | 4/2016 | Kim et al. | |
| 2017/0018848 | A1* | 1/2017 | Boutayeb | H01Q 9/0407 |
| 2019/0020100 | A1 | 1/2019 | Jong et al. | |
| 2019/0020110 | A1* | 1/2019 | Paulotto | H01Q 9/0414 |
| 2019/0027838 | A1 | 1/2019 | Paulotto et al. | |
| 2019/0166686 | A1 | 5/2019 | Jo et al. | |
| 2021/0111491 | A1* | 4/2021 | Hasegawa | H01Q 1/3275 |

* cited by examiner

Realized gain

XPD @ boresight

ANTENNA AND ELECTRONIC DEVICE INCLUDING THE SAME

CROSS-REFERENCE TO RELATED APPLICATION

This application is based on and claims priority under 35 U.S.C. § 119 to Korean Patent Application No. 10-2019-0147886, filed on Nov. 18, 2019, in the Korean Intellectual Property Office, the disclosure of which is incorporated by reference herein in its entirety.

BACKGROUND

Field

The disclosure relates to an antenna and an electronic device including the same.

Description of Related Art

With the development of wireless communication technology, electronic devices such as smart phones are widely used in everyday life, and thus the use of contents is increasing exponentially. Due to the rapid increase in the use of contents, the network capacity is gradually reaching the limit, and after the commercialization of 4th-generation (4G) communication systems, next-generation communication systems (e.g., a 5th-generation (5G) communication system, a pre-5G communication system, or a new radio (NR) communication system) using a super-high frequency (e.g., mmWave) band (e.g., 3 GHz to 300 GHz band) is now studied in order to satisfy the increasing demands of radio data traffic.

Next-generation wireless communication technology may transmit and receive signals using frequencies in the range of 3 GHz to 100 GHz. To overcome high free space loss due to the frequency characteristics and increase the antenna gain, efficient mounting structures and corresponding new antenna structures are being developed.

The antenna structure operating in the above frequency band may include, as an antenna element, at least one conductive patch that facilitates high gain and dual polarization. For example, the antenna structure may include plural conductive patches spaced apart from each other at a preset interval on a printed circuit board. These conductive patches can constitute an antenna array. When implemented with dual polarization, to simultaneously transmit separate radio signals on two carriers at the same frequency without interference, vertical polarization and horizontal polarization may be formed through a pair of feeding points respectively disposed at symmetrical positions on a pair of virtual lines that pass through the center of the conductive patch and are orthogonal to each other.

However, the polarization formed from one feeding point may lower the cross-polarization discrimination (XPD) characteristic and/or polarization isolation of the antenna due to the cross polarization component formed by the other feeding point.

SUMMARY

Embodiments of the disclosure may provide an antenna and an electronic device including the same.

Embodiments of the disclosure provide an antenna that can improve the XPD characteristic while maintaining the gain characteristic by changing the shape of the conductive patch, and an electronic device including the same.

According to various example embodiments, an electronic device is provided. The electronic device may include: a housing; and an antenna structure disposed in the internal space of the housing, wherein the antenna structure may include: a printed circuit board including a plurality of insulating layers; and at least one first conductive patch disposed on the printed circuit board, wherein the at least one first conductive patch may include: a first side having a first length; a second side parallel to the first side, spaced apart in a direction perpendicular to the first side, and having a second length shorter than the first length; a third side extending from one end of the first side in a direction perpendicular to the first side, and having a third length shorter than a vertical distance between the first side and the second side; a fourth side extending from an other end of the first side in a direction perpendicular to the first side, and having the third length; a fifth side connecting the third side and one end of the second side in a straight line; a sixth side connecting the fourth side and an other end of the second side in a straight line; a first feeding point disposed on a first virtual line passing through a center in the at least one first conductive patch and configured to transmit and/or receive a first signal of a first polarization; and a second feeding point disposed on a second virtual line passing through the center in the at least one first conductive patch and intersecting the first virtual line at a right angle and configured to transmit and/or receive a second signal of a second polarization perpendicular to the first polarization.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Hereinafter, various example embodiments of the disclosure will be described in greater detail with reference to the accompanying drawings.

Figure 1:
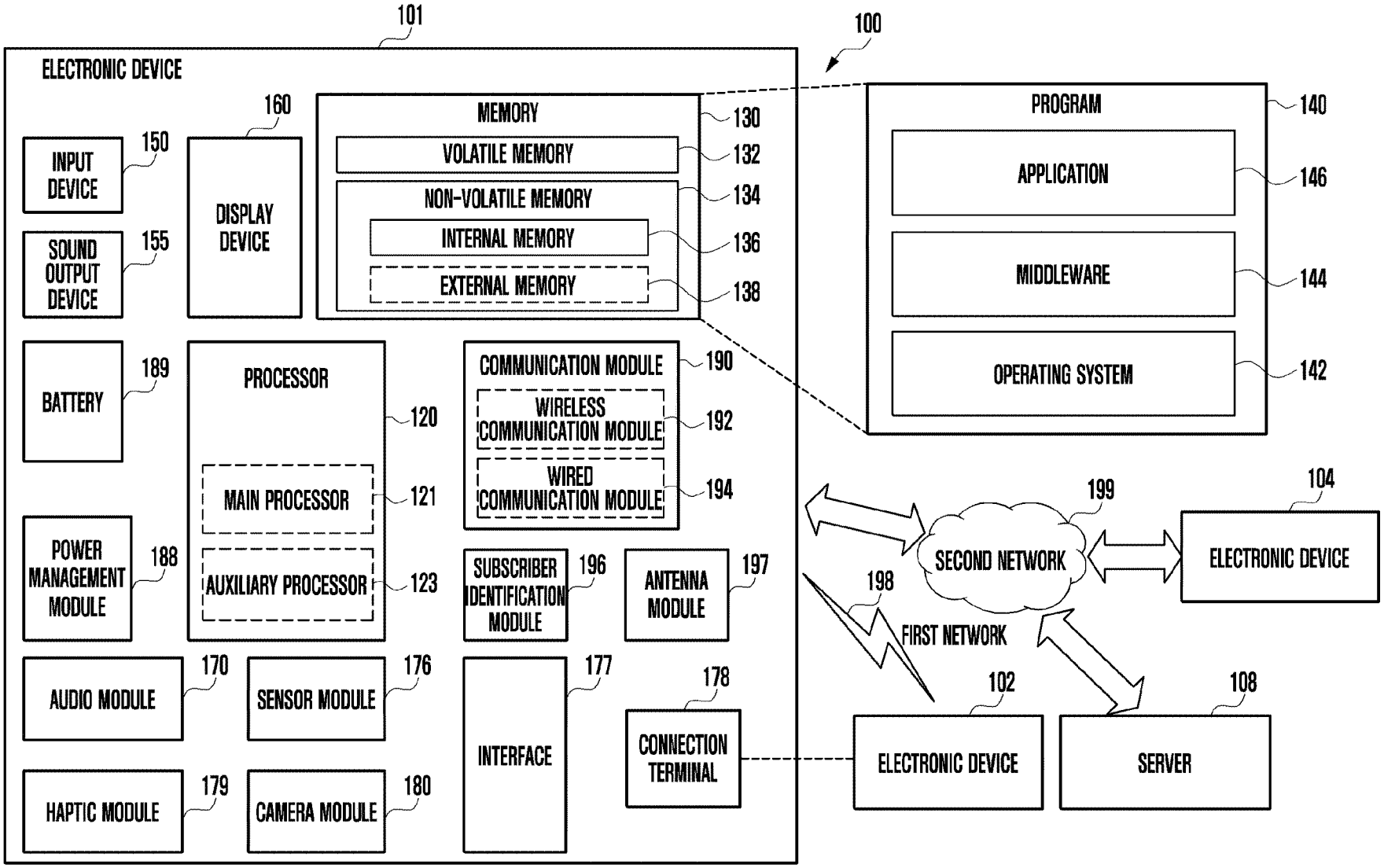
FIG. 1 is a block diagram illustrating an example electronic device in a network environment according to various embodiments.

FIG. 1 is a block diagram illustrating an example electronic device in a network environment according to various embodiments.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 includes a processor 120, memory 130, an input device 150, an audio output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. As at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). The auxiliary processor 123 (e.g., an ISP or a CP) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The audio output device 155 may output sound signals to the outside of the electronic device 101. The audio output device 155 may include, for example, a speaker or a receiver. The speaker may be used for general purposes, such as playing multimedia or playing record, and the receiver may be used for an incoming calls. The receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the audio output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. The interface 177 may include, for example, a high definition multimedia interface (HDMI), a universal serial bus (USB) interface, a secure digital (SD) card interface, or an audio interface.

A connection terminal 178 may include a connector via which the electronic device 101 may be physically connected with the external electronic device (e.g., the electronic device 102). The connection terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. The haptic module 179 may include, for example, a motor, a piezoelectric element, or an electric stimulator.

The camera module 180 may capture a image or moving images. The camera module 180 may include one or more lenses, image sensors, image signal processors, or flashes.

The power management module 188 may manage power supplied to the electronic device 101. The power management module 188 may be implemented as at least part of, for example, a power management integrated circuit (PMIC).

The battery 189 may supply power to at least one component of the electronic device 101. The battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the SIM 196.

The antenna module 197 may transmit or receive a signal or power to or from the outside (e.g., the external electronic device) of the electronic device 101. The antenna module 197 may include an antenna including a radiating element including a conductive material or a conductive pattern formed in or on a substrate (e.g., a printed circuit board (PCB)). The antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 and 104 may be a device of a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

An electronic device according to an embodiment may be one of various types of electronic devices. The electronic device may include a portable communication device (e.g., a smart phone), a computer device, a portable multimedia device, a portable medical device, a camera, a wearable device, a home appliance, or the like. However, the electronic device is not limited to any of those described above.

Various embodiments of the disclosure and the terms used herein are not intended to limit the technological features set forth herein to particular embodiments and include various changes, equivalents, or replacements for a corresponding embodiment.

With regard to the description of the drawings, similar reference numerals may be used to refer to similar or related elements.

A singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "1st" and "2nd", or "first" and "second" may be used to simply distinguish a corresponding component from another, and does not limit the components in other aspect (e.g., importance or order). If an element (e.g., a first element) is referred to, with or without the term "operatively" or "communicatively", as "coupled with", "coupled to", "connected with", or "connected to" another element (e.g., a second element), the element may be coupled with the other element directly (e.g., wiredly), wirelessly, or via a third element.

The term "module" may include a unit implemented in hardware, software, or firmware, or any combination thereof, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the "non-transitory" storage medium is a tangible device, and may not include a signal (e.g., an electromagnetic wave), but this term does not differentiate between where data is semi-permanently stored in the storage medium and where the data is temporarily stored in the storage medium.

A method according to an embodiment of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 2:
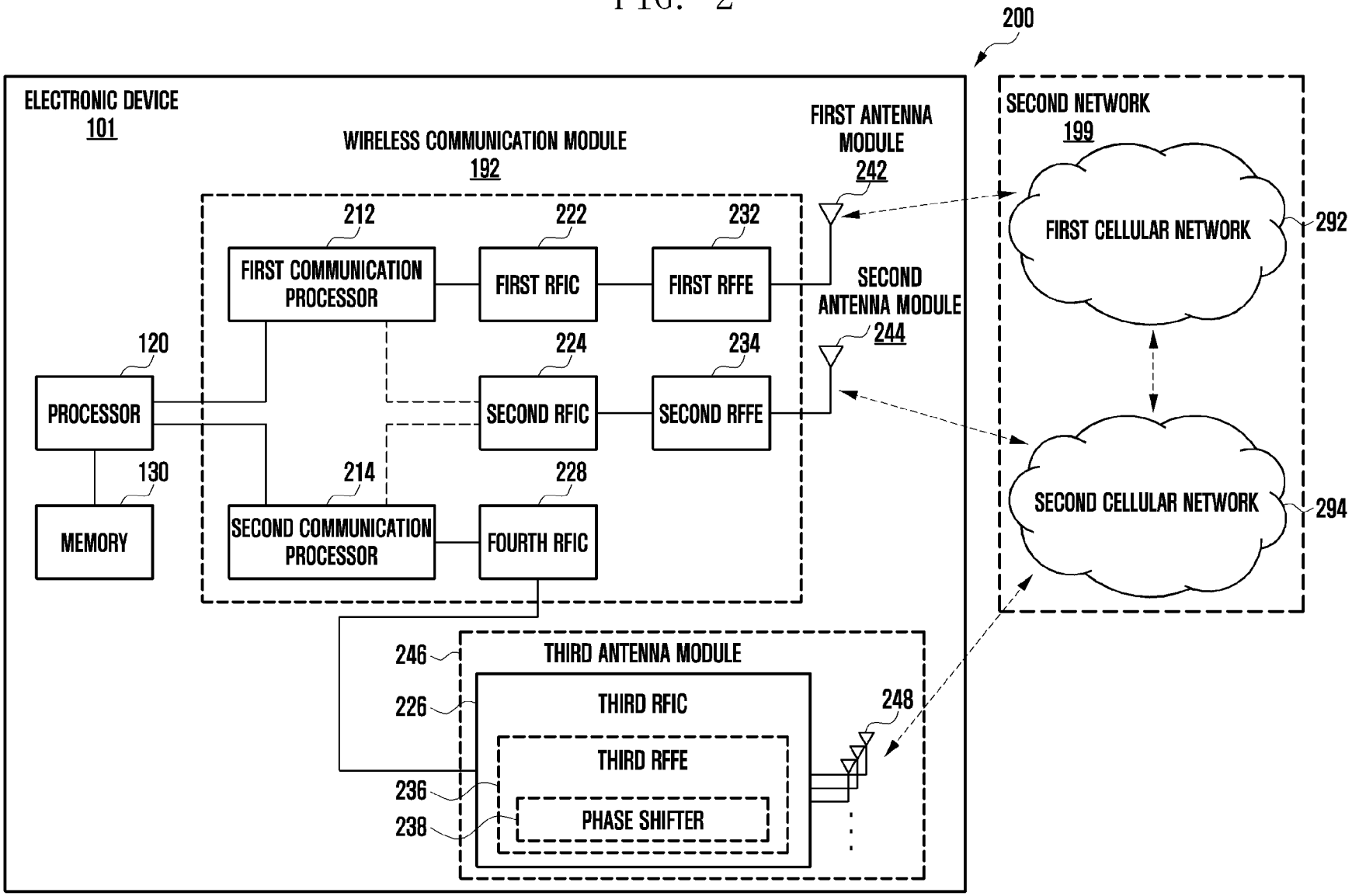
FIG. 2 is a block diagram illustrating an example electronic device supporting legacy network communication and 5G network communication according to various embodiments.

FIG. 2 is a block diagram illustrating an example electronic device supporting a legacy network communication and 5G network communication according to various embodiments.

Referring to FIG. 2, the electronic device 101 may include a first communication processor 212, second communication processor 214, first RFIC 222, second RFIC 224, third RFIC 226, fourth RFIC 228, first radio frequency front end (RFFE) 232, second RFFE 234, first antenna module 242, second antenna module 244, and antenna 248. The electronic device 101 may include a processor 120 and a memory 130. A second network 199 may include a first cellular network 292 and a second cellular network 294. According to an embodiment, the electronic device 101 may further include at least one of the components described with reference to FIG. 1, and the second network 199 may further include at least one other network. According to an embodiment, the first communication processor 212, second communication processor 214, first RFIC 222, second RFIC 224, fourth RFIC 228, first RFFE 232, and second RFFE 234 may form at least part of the wireless communication module 192. According to an embodiment, the fourth RFIC 228 may be omitted or included as part of the third RFIC 226.

The first communication processor 212 may establish a communication channel of a band to be used for wireless communication with the first cellular network 292 and support legacy network communication through the established communication channel. According to various embodiments, the first cellular network may be a legacy network including a second generation (2G), 3G, 4G, or long term evolution (LTE) network. The second communication processor 214 may establish a communication channel corresponding to a designated band (e.g., about 6 GHz to about 60 GHz) of bands to be used for wireless communication with the second cellular network 294, and support 5G network communication through the established communication channel. According to various embodiments, the second cellular network 294 may be a 5G network defined in 3GPP. Additionally, according to an embodiment, the first communication processor 212 or the second communication processor 214 may establish a communication channel corresponding to another designated band (e.g., about 6 GHz or less) of bands to be used for wireless communication with the second cellular network 294 and support 5G network communication through the established communication channel. According to an embodiment, the first communication processor 212 and the second communication processor 214 may be implemented in a single chip or a single package. According to various embodiments, the first communication processor 212 or the second communication processor 214 may be formed in a single chip or a single package with the processor 120, the auxiliary processor 123, or the communication module 190.

Upon transmission, the first RFIC 222 may convert a baseband signal generated by the first communication processor 212 to a radio frequency (RF) signal of about 700 MHz to about 3 GHz used in the first cellular network 292 (e.g., legacy network). Upon reception, an RF signal may be obtained from the first cellular network 292 (e.g., legacy network) through an antenna (e.g., the first antenna module 242) and be preprocessed through an RFFE (e.g., the first RFFE 232). The first RFIC 222 may convert the preprocessed RF signal to a baseband signal so as to be processed by the first communication processor 212.

Upon transmission, the second RFIC 224 may convert a baseband signal generated by the first communication processor 212 or the second communication processor 214 to an RF signal (hereinafter, 5G Sub6 RF signal) of a Sub6 band (e.g., 6 GHz or less) to be used in the second cellular network 294 (e.g., 5G network). Upon reception, a 5G Sub6 RF signal may be obtained from the second cellular network 294 (e.g., 5G network) through an antenna (e.g., the second antenna module 244) and be pretreated through an RFFE (e.g., the second RFFE 234). The second RFIC 224 may convert the preprocessed 5G Sub6 RF signal to a baseband signal so as to be processed by a corresponding communication processor of the first communication processor 212 or the second communication processor 214.

The third RFIC 226 may convert a baseband signal generated by the second communication processor 214 to an RF signal (hereinafter, 5G Above6 RF signal) of a 5G Above6 band (e.g., about 6 GHz to about 60 GHz) to be used in the second cellular network 294 (e.g., 5G network). Upon reception, a 5G Above6 RF signal may be obtained from the second cellular network 294 (e.g., 5G network) through an antenna (e.g., the antenna 248) and be preprocessed through the third RFFE 236. The third RFIC 226 may convert the preprocessed 5G Above6 RF signal to a baseband signal so as to be processed by the second communication processor 214. According to an embodiment, the third RFFE 236 may be formed as part of the third RFIC 226.

According to an embodiment, the electronic device 101 may include a fourth RFIC 228 separately from the third RFIC 226 or as at least part of the third RFIC 226. In this case, the fourth RFIC 228 may convert a baseband signal generated by the second communication processor 214 to an RF signal (hereinafter, an intermediate frequency (IF) signal) of an intermediate frequency band (e.g., about 9 GHz to about 11 GHz) and transfer the IF signal to the third RFIC 226. The third RFIC 226 may convert the IF signal to a 5G Above 6RF signal. Upon reception, the 5G Above 6RF signal may be received from the second cellular network 294 (e.g., a 5G network) through an antenna (e.g., the antenna 248) and be converted to an IF signal by the third RFIC 226. The fourth RFIC 228 may convert an IF signal to a baseband signal so as to be processed by the second communication processor 214.

According to an embodiment, the first RFIC 222 and the second RFIC 224 may be implemented into at least part of a single package or a single chip. According to an embodiment, the first RFFE 232 and the second RFFE 234 may be implemented into at least part of a single package or a single chip. According to an embodiment, at least one of the first antenna module 242 or the second antenna module 244 may be omitted or may be combined with another antenna module to process RF signals of a corresponding plurality of bands.

According to an embodiment, the third RFIC 226 and the antenna 248 may be disposed at the same substrate to form a third antenna module 246. For example, the wireless communication module 192 or the processor 120 may be disposed at a first substrate (e.g., main PCB). In this case, the third RFIC 226 is disposed in a partial area (e.g., lower surface) of the first substrate and a separate second substrate (e.g., sub PCB), and the antenna 248 is disposed in another partial area (e.g., upper surface) thereof; thus, the third antenna module 246 may be formed. By disposing the third RFIC 226 and the antenna 248 in the same substrate, a length of a transmission line therebetween can be reduced. This may reduce, for example, a loss (e.g., attenuation) of a signal of a high frequency band (e.g., about 6 GHz to about 60 GHz) to be used in 5G network communication by a transmission line. Therefore, the electronic device 101 may improve a quality or speed of communication with the second cellular network 294 (e.g., 5G network).

According to an embodiment, the antenna 248 may be formed in an antenna array including a plurality of antenna elements that may be used for beamforming. In this case, the third RFIC 226 may include a plurality of phase shifters 238 corresponding to a plurality of antenna elements, for example, as part of the third RFFE 236. Upon transmission, each of the plurality of phase shifters 238 may convert a phase of a 5G Above6 RF signal to be transmitted to the outside (e.g., a base station of a 5G network) of the electronic device 101 through a corresponding antenna element. Upon reception, each of the plurality of phase shifters 238 may convert a phase of the 5G Above6 RF signal received from the outside to the same phase or substantially the same phase through a corresponding antenna element. This enables transmission or reception through beamforming between the electronic device 101 and the outside.

The second cellular network 294 (e.g., 5G network) may operate (e.g., stand-alone (SA)) independently of the first cellular network 292 (e.g., legacy network) or may be operated (e.g., non-stand alone (NSA)) in connection with the first cellular network 292. For example, the 5G network may have only an access network (e.g., 5G radio access network (RAN) or a next generation (NG) RAN and have no core network (e.g., next generation core (NGC)). In this case, after accessing to the access network of the 5G network, the electronic device 101 may access to an external network (e.g., Internet) under the control of a core network (e.g., an evolved packed core (EPC)) of the legacy network. Protocol information (e.g., LTE protocol information) for communication with a legacy network or protocol information (e.g., new radio (NR) protocol information) for communication with a 5G network may be stored in the memory 130 to be accessed by other components (e.g., the processor 120, the first communication processor 212, or the second communication processor 214).

Figure 3A:
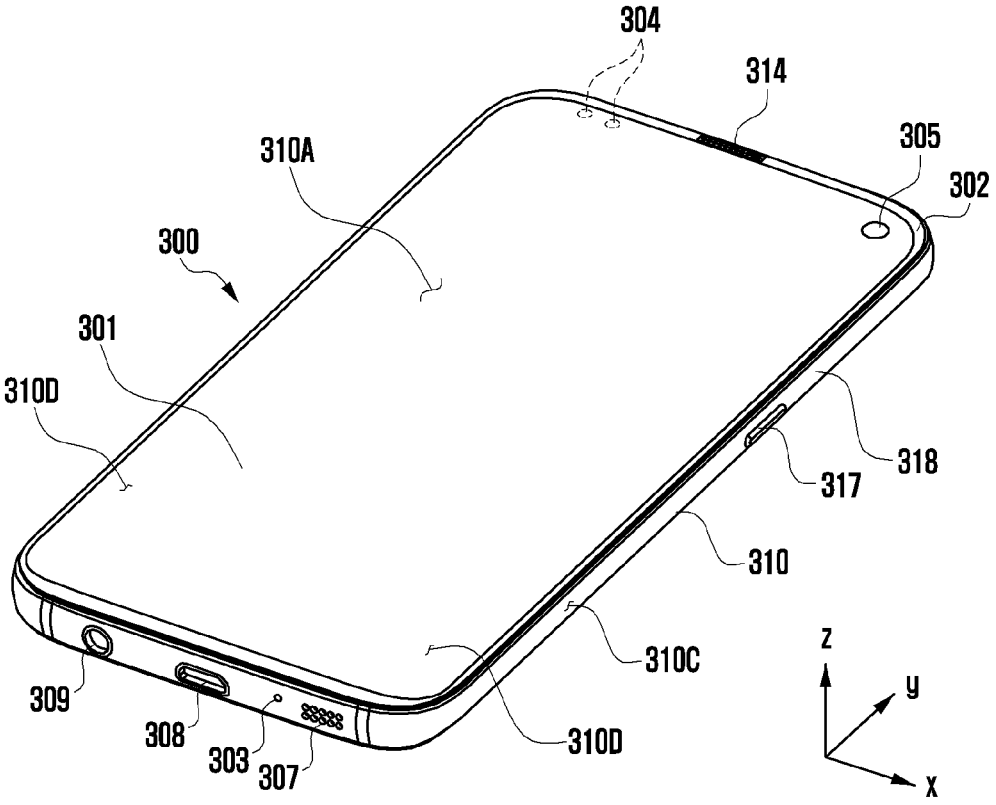
FIG. 3A is a front perspective view of an example mobile electronic device according to various embodiments.
Figure 3B:
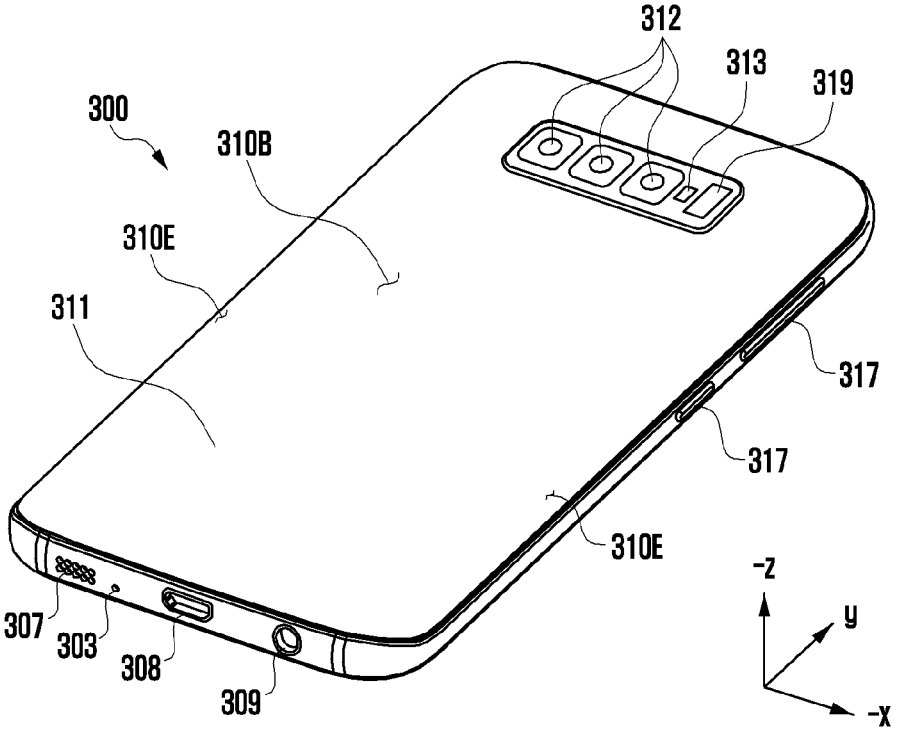
FIG. 3B is a rear perspective view of an example mobile electronic device according to various embodiments.

FIG. 3A is a front perspective view of an example mobile electronic device according various embodiments, and FIG. 3B is a rear perspective view of the mobile electronic device shown in FIG. 3A according to various embodiments.

Referring to FIGS. 3A and 3B, a mobile electronic device 300 may include a housing 310 that includes a first surface (or front surface) 310A, a second surface (or rear surface) 310B, and a lateral surface 310C that surrounds a space between the first surface 310A and the second surface 310B. The housing 310 may refer to a structure that forms a part of the first surface 310A, the second surface 310B, and the lateral surface 310C. The first surface 310A may be formed of a front plate 302 (e.g., a glass plate or polymer plate coated with a variety of coating layers) at least a part of which is substantially transparent. The second surface 310B may be formed of a rear plate 311 which is substantially opaque. The rear plate 311 may be formed of, for example, coated or colored glass, ceramic, polymer, metal (e.g., aluminum, stainless steel (STS), or magnesium), or any combination thereof. The lateral surface 310C may be formed of a lateral bezel structure (or "lateral member") 318 which is combined with the front plate 302 and the rear plate 311 and includes a metal and/or polymer. The rear plate 311 and the lateral bezel structure 318 may be integrally formed and may be of the same material (e.g., a metallic material such as aluminum).

The front plate 302 may include two first regions 310D disposed at long edges thereof, respectively, and bent and extended seamlessly from the first surface 310A toward the rear plate 311. Similarly, the rear plate 311 may include two second regions 310E disposed at long edges thereof, respectively, and bent and extended seamlessly from the second surface 310B toward the front plate 302. The front plate 302 (or the rear plate 311) may include only one of the first regions 310D (or of the second regions 310E). The first regions 310D or the second regions 310E may be omitted in part. When viewed from a lateral side of the mobile electronic device 300, the lateral bezel structure 318 may have a first thickness (or width) on a lateral side where the first region 310D or the second region 310E is not included, and may have a second thickness, being less than the first thickness, on another lateral side where the first region 310D or the second region 310E is included.

The mobile electronic device 300 may include at least one of a display 301, audio modules 303, 307 and 314, sensor modules 304 and 319, camera modules 305, 312 and 313, a key input device 317, a light emitting device, and connector holes 308 and 309. The mobile electronic device 300 may omit at least one (e.g., the key input device 317 or the light emitting device) of the above components, or may further include other components.

The display 301 may be viewable or visible through a substantial portion of the front plate 302, for example. At least a part of the display 301 may be visible through the front plate 302 that forms the first surface 310A and the first region 310D of the lateral surface 310C. Outlines (i.e., edges and corners) of the display 301 may have substantially the same form as those of the front plate 302. The spacing between the outline of the display 301 and the outline of the front plate 302 may be substantially unchanged in order to enlarge the visible area of the display 301.

A recess or opening may be formed in a portion of a display area of the display 301 to accommodate at least one of the audio module 314, the sensor module 304, the camera module 305, and the light emitting device. At least one of the audio module 314, the sensor module 304, the camera module 305, a fingerprint sensor (not shown), and the light emitting element may be disposed on the back of the display area of the display 301. The display 301 may be combined with, or adjacent to, a touch sensing circuit, a pressure sensor capable of measuring the touch strength (pressure), and/or a digitizer for detecting a stylus pen. At least a part of the sensor modules 304 and 319 and/or at least a part of the key input device 317 may be disposed in the first region 310D and/or the second region 310E.

The audio modules 303, 307 and 314 may correspond to a microphone hole 303 and speaker holes 307 and 314, respectively. The microphone hole 303 may contain a microphone disposed therein for acquiring external sounds and, in a case, contain a plurality of microphones to sense a sound direction. The speaker holes 307 and 314 may be classified into an external speaker hole 307 and a call receiver hole 314. The microphone hole 303 and the speaker holes 307 and 314 may be implemented as a single hole, or a speaker (e.g., a piezo speaker) may be provided without the speaker holes 307 and 314.

The sensor modules 304 and 319 may generate electrical signals or data corresponding to an internal operating state of the mobile electronic device 300 or to an external environmental condition. The sensor modules 304 and 319 may include a first sensor module 304 (e.g., a proximity sensor) and/or a second sensor module (e.g., a fingerprint sensor) disposed on the first surface 310A of the housing 310, and/or a third sensor module 319 (e.g., a heart rate monitor (HRM) sensor) and/or a fourth sensor module (e.g., a fingerprint sensor) disposed on the second surface 310B of the housing 310. The fingerprint sensor may be disposed on the second surface 310B as well as the first surface 310A (e.g., the display 301) of the housing 310. The electronic device 300 may further include at least one of a gesture sensor, a gyro sensor, an air pressure sensor, a magnetic sensor, an acceleration sensor, a grip sensor, a color sensor, an infrared (IR) sensor, a biometric sensor, a temperature sensor, a humidity sensor, or an illuminance sensor.

The camera modules 305, 312 and 313 may include a first camera device 305 disposed on the first surface 310A of the electronic device 300, and a second camera module 312 and/or a flash 313 disposed on the second surface 310B. The camera module 305 or the camera module 312 may include one or more lenses, an image sensor, and/or an image signal processor. The flash 313 may include, for example, a light emitting diode or a xenon lamp. Two or more lenses (infrared cameras, wide angle and telephoto lenses) and image sensors may be disposed on one side of the electronic device 300.

The key input device 317 may be disposed on the lateral surface 310C of the housing 310. The mobile electronic device 300 may not include some or all of the key input device 317 described above, and the key input device 317 which is not included may be implemented in another form such as a soft key on the display 301. The key input device 317 may include the sensor module disposed on the second surface 310B of the housing 310.

The light emitting device may be disposed on the first surface 310A of the housing 310. For example, the light emitting device may provide status information of the electronic device 300 in an optical form. The light emitting device may provide a light source associated with the operation of the camera module 305. The light emitting device may include, for example, a light emitting diode (LED), an IR LED, or a xenon lamp.

The connector holes 308 and 309 may include a first connector hole 308 adapted for a connector (e.g., a universal serial bus (USB) connector) for transmitting and receiving power and/or data to and from an external electronic device, and/or a second connector hole 309 adapted for a connector (e.g., an earphone jack) for transmitting and receiving an audio signal to and from an external electronic device.

Some modules 305 of camera modules 305 and 312, some sensor modules 304 of sensor modules 304 and 319, or an indicator may be arranged to be viewable through a display 301. For example, the camera module 305, the sensor module 304, or the indicator may be arranged in the internal space of an electronic device 300 so as to be brought into contact with an external environment through an opening of the display 301, which is perforated up to a front plate 302. In an embodiment, some sensor modules 304 may be arranged to perform their functions without being visually visible through the front plate 302 in the internal space of the electronic device. For example, in this case, an area of the display 301 facing the sensor module may not require a perforated opening.

Figure 3C:
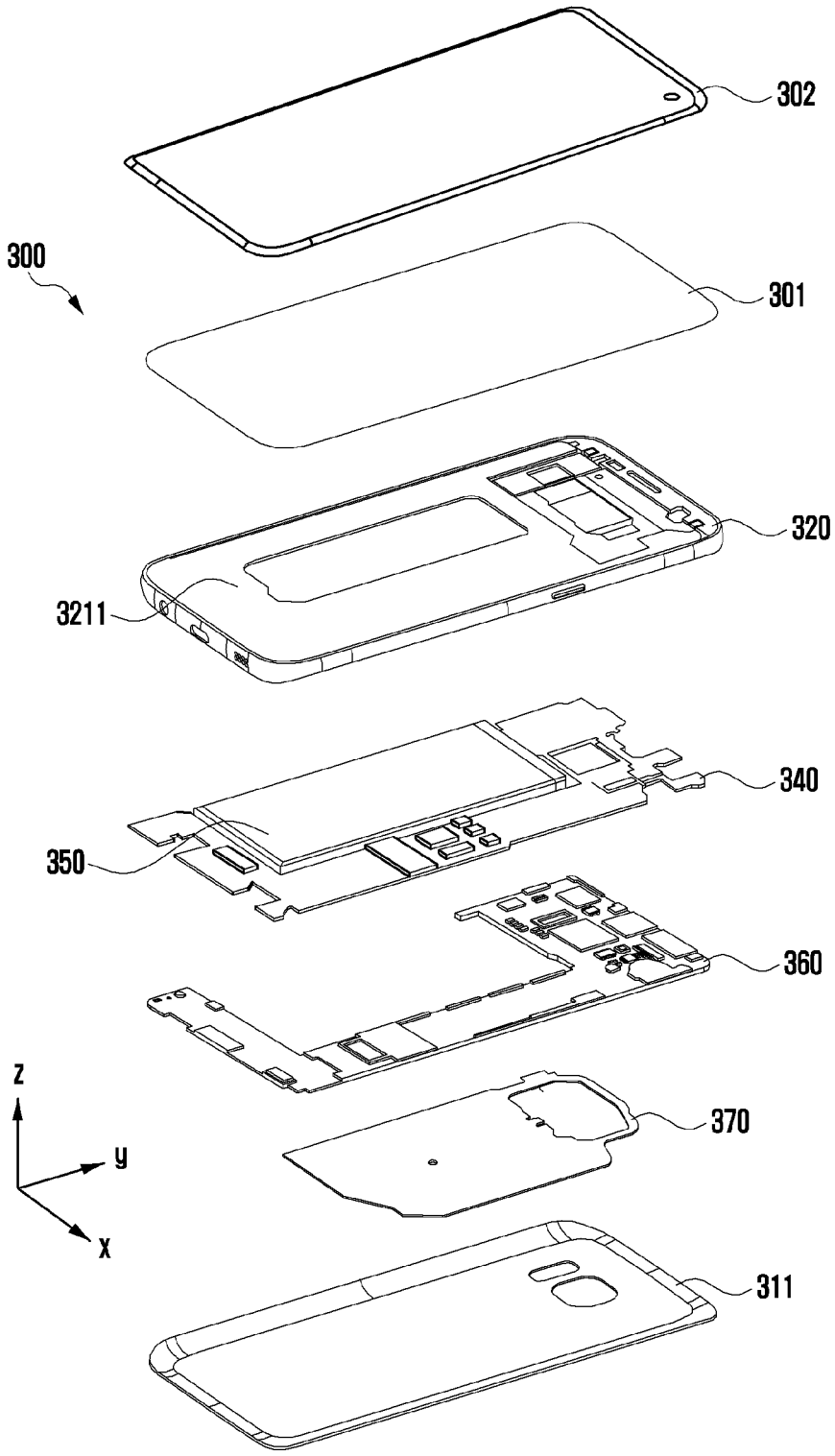
FIG. 3C is an exploded perspective view of an example mobile electronic device according to various embodiments.

FIG. 3C is an exploded perspective view of a mobile electronic device shown in FIG. 3A according to various embodiments.

Referring to FIG. 3C a mobile electronic device 300 may include a lateral bezel structure 320, a first support member 3211 (e.g., a bracket), a front plate 302, a display 301, an electromagnetic induction panel (not shown), a printed circuit board (PCB) 340, a battery 350, a second support member 360 (e.g., a rear case), an antenna 370, and a rear plate 311. The mobile electronic device 300 may omit at least one (e.g., the first support member 3211 or the second support member 360) of the above components or may further include another component. Some components of the electronic device 300 may be the same as or similar to those of the mobile electronic device 101 shown in FIG. 1 or FIG. 2, thus, descriptions thereof may not be repeated below.

The first support member 3211 is disposed inside the mobile electronic device 300 and may be connected to, or integrated with, the lateral bezel structure 320. The first support member 3211 may be formed of, for example, a metallic material and/or a non-metal (e.g., polymer) material. The first support member 3211 may be combined with the display 301 at one side thereof and also combined with the printed circuit board (PCB) 340 at the other side thereof. On the PCB 340, a processor, a memory, and/or an interface may be mounted. The processor may include, for example, one or more of a central processing unit (CPU), an application processor (AP), a graphics processing unit (GPU), an image signal processor (ISP), a sensor hub processor, or a communications processor (CP).

The memory may include, for example, one or more of a volatile memory and a non-volatile memory.

The interface may include, for example, a high definition multimedia interface (HDMI), a USB interface, a secure digital (SD) card interface, and/or an audio interface. The interface may electrically or physically connect the mobile electronic device 300 with an external electronic device and may include a USB connector, an SD card/multimedia card (MMC) connector, or an audio connector.

The battery 350 is a device for supplying power to at least one component of the mobile electronic device 300, and may include, for example, a non-rechargeable primary battery, a rechargeable secondary battery, or a fuel cell. At least a part of the battery 350 may be disposed on substantially the same plane as the PCB 340. The battery 350 may be integrally disposed within the mobile electronic device 300, and may be detachably disposed from the mobile electronic device 300.

The antenna 370 may be disposed between the rear plate 311 and the battery 350. The antenna 370 may include, for example, a near field communication (NFC) antenna, a wireless charging antenna, and/or a magnetic secure transmission (MST) antenna. The antenna 370 may perform short-range communication with an external device, or transmit and receive power required for charging wirelessly. An antenna structure may be formed by a part or combination of the lateral bezel structure 320 and/or the first support member 3211.

Figure 4A:
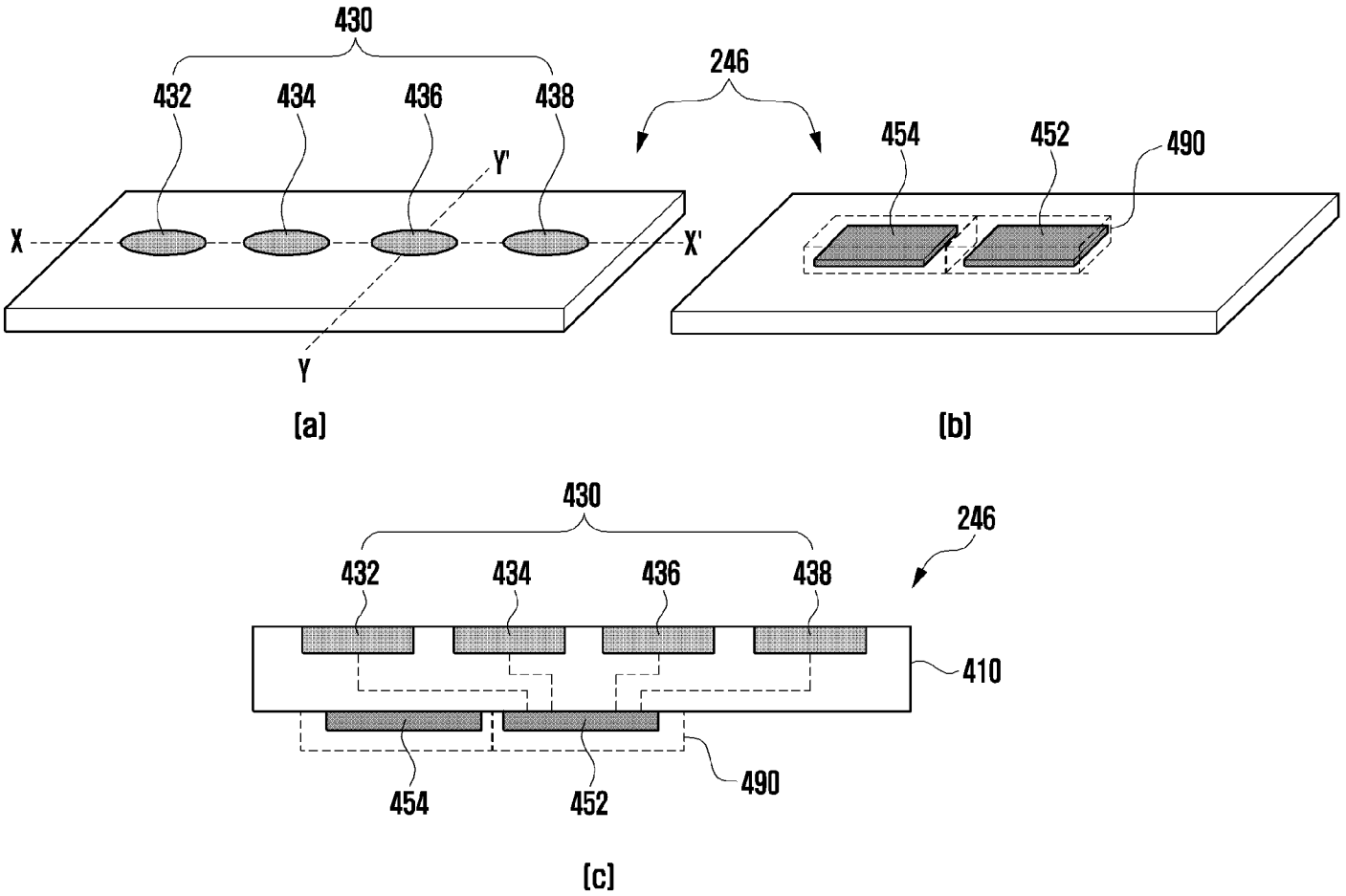
FIG. 4A is a diagram illustrating an example structure of the third antenna module illustrated in FIG. 2 according to various embodiments.

FIG. 4A is a diagram illustrating an example structure of a third antenna module described with reference to FIG. 2 according to various embodiments.

Referring to FIG. 4A, (a) is a perspective view illustrating the third antenna module 246 viewed from one side, and (b) is a perspective view illustrating the third antenna module 246 viewed from the other side. FIG. 4A (c) is a cross-sectional view illustrating the third antenna module 246 taken along line X-X' of FIG. 4A.

With reference to FIG. 4A, in an embodiment, the third antenna module 246 may include a printed circuit board 410, an antenna array 430, a RFIC 452, and a PMIC 454. The third antenna module 246 may further include a shield member 490. In other embodiments, at least one of the above-described components may be omitted or at least two of the components may be integrally formed.

The printed circuit board 410 may include a plurality of conductive layers and a plurality of non-conductive layers stacked alternately with the conductive layers. The printed circuit board 410 may provide electrical connections between the printed circuit board 410 and/or various electronic components disposed outside using wirings and conductive vias formed in the conductive layer.

The antenna array 430 (e.g., 248 of FIG. 2) may include a plurality of antenna elements 432, 434, 436, or 438 disposed to form a directional beam. As illustrated, the antenna elements 432, 434, 436, or 438 may be formed at a first surface of the printed circuit board 410. According to an embodiment, the antenna array 430 may be formed inside the printed circuit board 410. According to the embodiment, the antenna array 430 may include the same or a different shape or kind of a plurality of antenna arrays (e.g., dipole antenna array and/or patch antenna array).

The RFIC 452 (e.g., the third RFIC 226 of FIG. 2) may be disposed at another area (e.g., a second surface opposite to the first surface) of the printed circuit board 410 spaced apart from the antenna array. The RFIC 452 is configured to process signals of a selected frequency band transmitted/received through the antenna array 430. According to an embodiment, upon transmission, the RFIC 452 may convert a baseband signal obtained from a communication processor (not shown) to an RF signal of a designated band. Upon reception, the RFIC 452 may convert an RF signal received through the antenna array 430 to a baseband signal and transfer the baseband signal to the communication processor.

According to an embodiment, upon transmission, the RFIC 452 may up-convert an IF signal (e.g., about 9 GHz to about 11 GHz) obtained from an intermediate frequency integrate circuit (IFIC) (e.g., 228 of FIG. 2) to an RF signal of a selected band. Upon reception, the RFIC 452 may down-convert the RF signal obtained through the antenna array 430, convert the RF signal to an IF signal, and transfer the IF signal to the IFIC.

The PMIC 454 may be disposed in another partial area (e.g., the second surface) of the printed circuit board 410 spaced apart from the antenna array 430. The PMIC 454 may receive a voltage from a main PCB (not illustrated) to provide power necessary for various components (e.g., the RFIC 452) on the antenna module.

The shielding member 490 may be disposed at a portion (e.g., the second surface) of the printed circuit board 410 so as to electromagnetically shield at least one of the RFIC 452 or the PMIC 454. According to an embodiment, the shield member 490 may include a shield can.

Although not shown, in various embodiments, the third antenna module 246 may be electrically connected to another printed circuit board (e.g., main circuit board) through a module interface. The module interface may include a connecting member, for example, a coaxial cable connector, board to board connector, interposer, or flexible printed circuit board (FPCB). The RFIC 452 and/or the PMIC 454 of the antenna module may be electrically connected to the printed circuit board through the connection member.

Figure 4B:
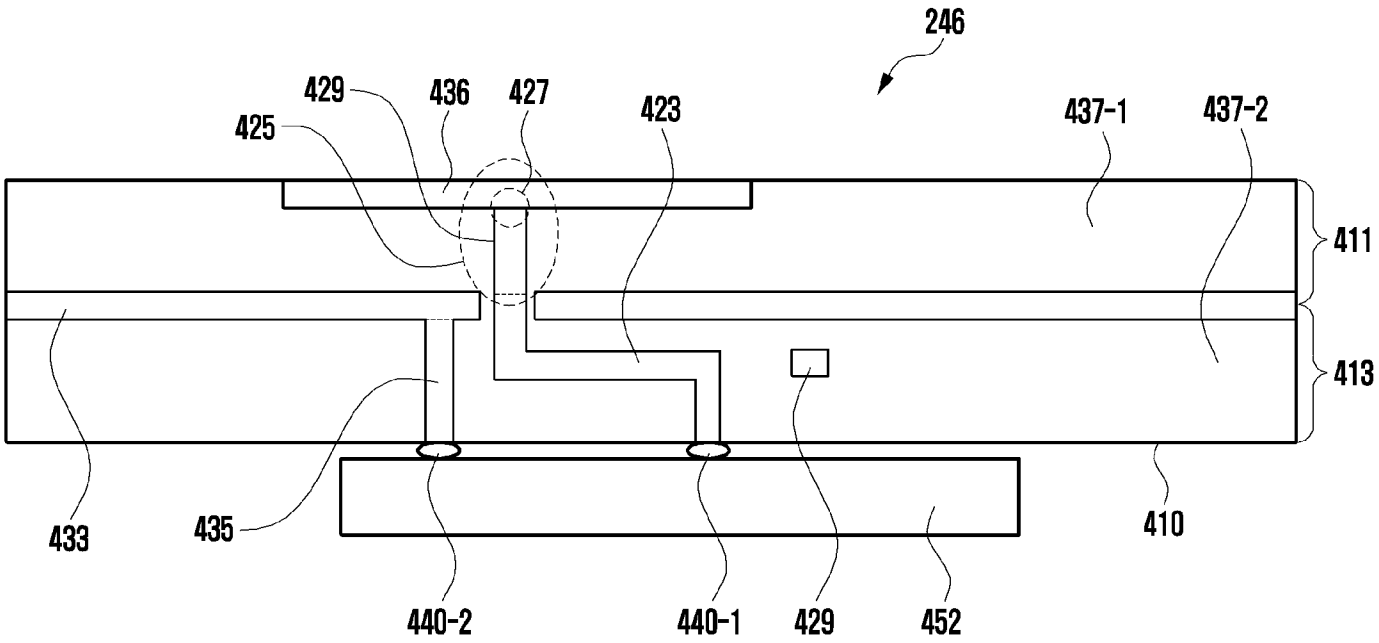
FIG. 4B is a cross-sectional view of the third antenna module along the line Y-Y' shown in part (a) of FIG. 4A according to various embodiments.

FIG. 4B is a cross-sectional view illustrating the third antenna module 246 taken along line Y-Y' of FIG. 4A (a) according to various embodiments. The printed circuit board 410 of the illustrated embodiment may include an antenna layer 411 and a network layer 413.

Referring to FIG. 4B, the antenna layer 411 may include at least one dielectric layer 437-1, and an antenna element 436 and/or a power feeding portion 425 formed on or inside an outer surface of a dielectric layer. The power feeding portion 425 may include a power feeding point 427 and/or a power feeding line 429.

The network layer 413 may include at least one dielectric layer 437-2, at least one ground layer 433, at least one conductive via 435, a transmission line 423, and/or a power feeding line 429 formed on or inside an outer surface of the dielectric layer.

Further, in the illustrated embodiment, the RFIC 452 (e.g., the third RFIC 226 of FIG. 2) of FIG. 4A (c) may be electrically connected to the network layer 413 through, for example, first and second solder bumps 440-1 and 440-2. In other embodiments, various connection structures (e.g., solder or ball grid array (BGA)) instead of the solder bumps may be used. The RFIC 452 may be electrically connected to the antenna element 436 through the first solder bump 440-1, the transmission line 423, and the power feeding portion 425. The RFIC 452 may also be electrically connected to the ground layer 433 through the second solder bump 440-2 and the conductive via 435. Although not illustrated, the RFIC 452 may also be electrically connected to the above-described module interface through the power feeding line 429.

Figure 5A:
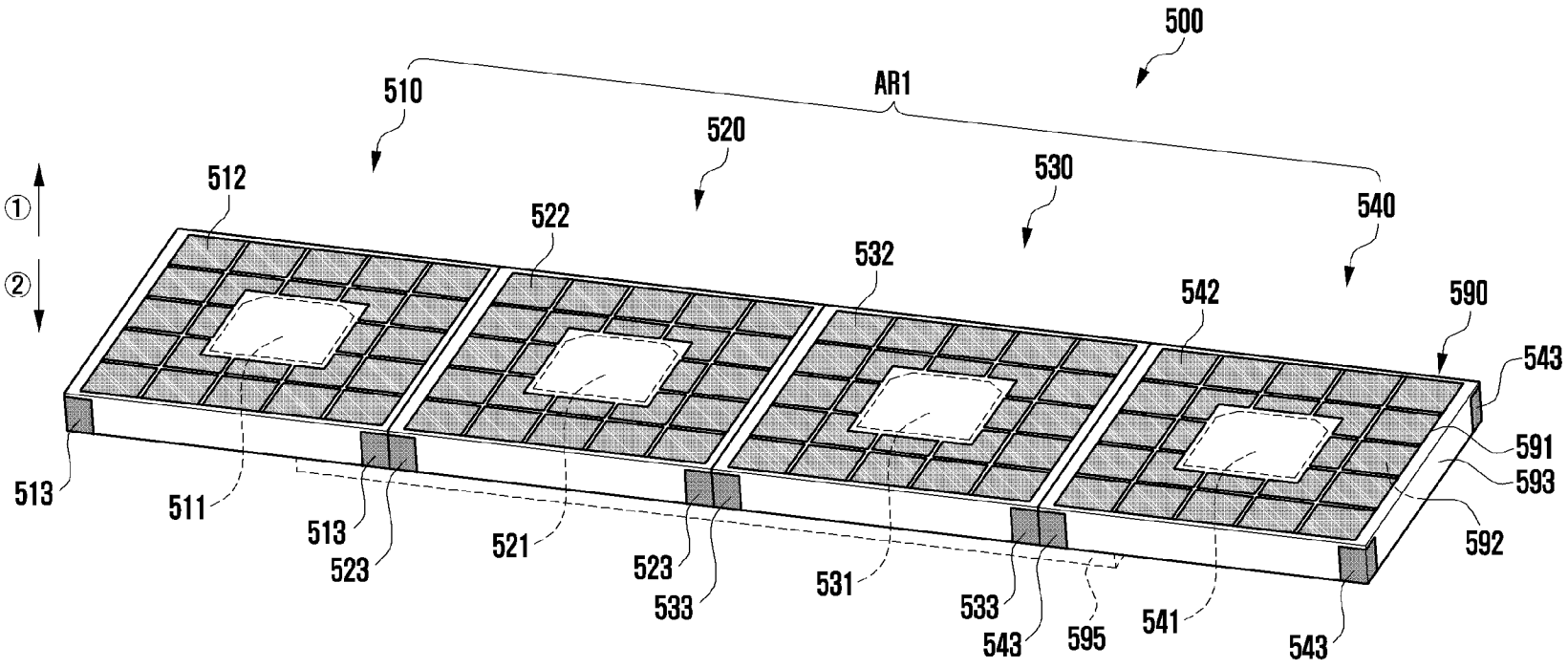
FIG. 5A is a perspective view of an example antenna structure according to various embodiments.
Figure 5B:
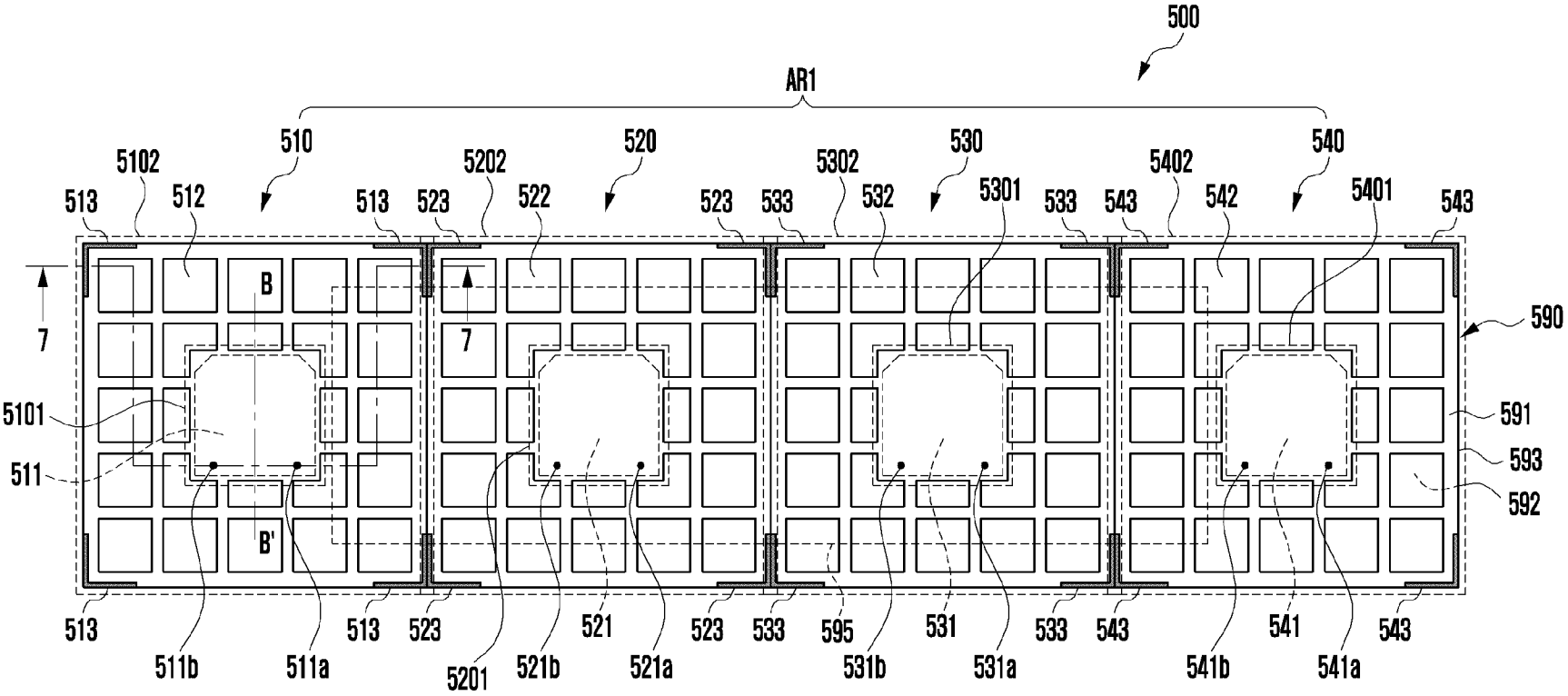
FIG. 5B is a top view of the antenna structure according to various embodiments.

FIG. 5A is a perspective view illustrating an example antenna structure 500 according to various embodiments. FIG. 5B is a top view of the antenna structure 500 according to various embodiments.

The antenna structure 500 of FIGS. 5A and 5B may be at least partially similar to the third antenna module 246 of FIG. 4A, or may further include other embodiments of an antenna structure.

With reference to FIGS. 5A and 5B, the antenna structure 500 (e.g., antenna module 246 in FIG. 4A) may include a printed circuit board 590 (e.g., printed circuit board 410 in FIG. 4A), and an antenna array AR1 (e.g., antenna array 430 in FIG. 4A) including antennas 510, 520, 530 and 540 (e.g., antenna elements 432, 434, 436 and 438 in FIG. 4A) disposed on the printed circuit board 590. In an embodiment, the printed circuit board 590 may include a first surface 591 facing in a first direction (direction ①) (e.g., negative z direction in FIG. 3B), a second surface 592 facing in a direction opposite to the first surface 591 (direction ②) (e.g., z direction in FIG. 3A), and a side surface 593 surrounding the space between the first surface 591 and the second surface 592. In an embodiment, the antenna structure 500 may further include a wireless communication circuit 595 (e.g., RFIC 452 in FIG. 4A) disposed on the second surface 592 of the printed circuit board 590. In an embodiment, the antennas 510, 520, 530 and 540 may be electrically connected to the wireless communication circuit 595. In an embodiment, the wireless communication circuit 595 may be configured to transmit and/or receive a radio signal in the range of about 3 GHz to 100 GHz through the antenna array AR1. In an embodiment, the wireless communication circuit 595 may be disposed in a position spaced apart from the printed circuit board 590 in the internal space of the electronic device (e.g., electronic device 300 in FIG. 3A), and may be electrically connected to the antennas 510, 520, 530 and 540 through an electrical connection member (e.g., flexible printed circuit board (FPCB) type RF cable (FRC) or coaxial cable).

In various embodiments, the antennas 510, 520, 530 and 540 may include a first antenna 510, a second antenna 520, a third antenna 530, and a fourth antenna 540, which are arranged at regular intervals on the first surface 591 of the printed circuit board 590. The antennas 510, 520, 530 and 540 may have substantially the same configuration. The antenna structure 500 has been described as being an antenna array AR1 including four antennas 510, 520, 530 and 540, but example embodiments of the disclosure are not limited thereto. For example, the antenna structure 500, as an antenna array AR1, may include one antenna, two antennas, or five or more antennas.

In various embodiments, when the first surface 591 of the printed circuit board 590 is viewed from above, the first antenna 510 may include a first conductive patch 511 disposed through a first region 5101 and/or second conductive patches 512 periodically disposed through a second region 5102 surrounding the first region 5101. In an embodiment, the first conductive patch 511 may be disposed to be capacitively coupled with the second conductive patches 512. In an embodiment, the first antenna 510 may include at least one first conductive wall 513 formed on at least a portion of the outer periphery of the second region 5102 when the first surface 591 is viewed from above. In an embodiment, the at least one first conductive wall 513 may be electrically and physically connected to the ground layer (e.g., ground layer 5903 in FIG. 7) of the printed circuit board 590 and may be arranged at positions capacitively coupable to the plural second conductive patches 512.

In various embodiments, the first conductive patch 511 may be formed in a left-right symmetrical shape so as to comprise a dual polarized antenna. In an embodiment, the first conductive patch 511 may be electrically connected to the wireless communication circuit 595 through a pair of feeding points 511*a* and 511*b*. In an embodiment, the pair of feeding points 511*a* and 511*b* may include a first feeding point 511*a* and a second feeding point 511*b* that are symmetrically disposed with respect to a line crossing the center of the first conductive patch 511.

In various embodiments, the second conductive patches 512 may be arranged in a manner surrounding the first conductive patch 511 so that the first conductive patch 511 is located at the center when the first surface 591 is viewed from above. In an embodiment, the second conductive patches 512 may be exposed on the first surface 591 of the printed circuit board 590 or may be disposed close to the first surface 591 within the printed circuit board 590. In an embodiment, the second conductive patches 512 may be disposed on an insulating layer different from the insulating layer on which the first conductive patch 511 is disposed in the printed circuit board 590. In an embodiment, the second conductive patches 512 may be disposed on an insulating layer closer to the first surface 591 than the first conductive patch 511. In an embodiment, the second conductive patches 512 may be disposed side by side on the same insulating layer as the first conductive patch 511. In an embodiment, the second conductive patches 512 may be disposed on an insulating layer farther from the first surface 591 than the first conductive patch 511. In an embodiment, the second conductive patches 512 may be disposed in parallel with the first conductive patch 511 when the first surface 591 is viewed from above. In an embodiment, the second conductive patches 512 may be disposed to at least partially overlap the first conductive patch 511 when the first surface 591 is viewed from above. In this case, the second conductive patches 512 and the first conductive patch 511 may be disposed on different insulating layers of the printed circuit board 590. In an embodiment, as shown, the second conductive patches 512 may be formed as a rectangular conductive plate. In an embodiment, the second conductive patches 512 may be formed in a circular shape, in an oval shape, or in a variety of polygons other than a rectangle. In an embodiment, when the first conductive patch 511 is realized as a dual polarized antenna, the overall shape formed by the second conductive patches 512 may be arranged to have an up-down, left-right symmetrical structure.

In various embodiments, at least one first conductive wall 513 may be disposed on the side surface 593 of the printed circuit board 590. In an embodiment, the at least one first conductive wall 513 may be disposed to be exposed or not to be exposed on the side surface 593 of the printed circuit board 590. In an embodiment, the at least one first conductive wall 513 may be disposed at preset intervals along the outer periphery of the second region 5102 of the printed circuit board 590 in which the second conductive patches 512 are disposed. In an embodiment, the at least one first conductive wall 513 may be disposed at preset intervals in a region couplable to the second conductive patches 512 other than the side surface of the printed circuit board 590. In an embodiment, when the first conductive patch 511 operates as a dual-polarized antenna or a dual-polarized dual-feed antenna, the at least one first conductive wall 513 may be disposed at preset intervals along the outer peripheries of the second conductive patches 512, and may maintain the initial arrangement structure before rotation even if the second conductive patches 512 are rotated 90 degrees, 180 degrees, or 270 degrees. In an embodiment, the at least one first conductive wall 513 may be disposed at each corner portion of the printed circuit board 590 of a rectangular shape along the outer peripheries of the second conductive patches 512.

In various embodiments, the second antenna 520, the third antenna 530 and/or the fourth antenna 540 may have substantially the same configuration as the first antenna 510. In an embodiment, when the first surface 591 is viewed from above, the second antenna 520 may include a third conductive patch 521 disposed in a third region 5201 and/or fourth conductive patches 522 disposed in a fourth region 5202 surrounding the third region 5201. In an embodiment, the third conductive patch 521 may include a third feeding point 521*a* and/or a fourth feeding point 521*b*. In an embodiment, the second antenna 520 may include at least one second conductive wall 523 formed on at least a portion of the outer periphery of the fourth region 5202 when the first surface 591 is viewed from above.

In various embodiments, when the first surface 591 is viewed from above, the third antenna 530 may include a fifth conductive patch 531 disposed in a fifth region 5301 and/or sixth conductive patches 532 disposed in a sixth region 5302 surrounding the fifth region 5301. In an embodiment, the fifth conductive patch 531 may include a fifth feeding point 531*a* and/or a sixth feeding point 531*b*. In an embodiment, the third antenna 530 may include at least one third conductive wall 533 formed on at least a portion of the outer periphery of the sixth region 5302 when the first surface 591 is viewed from above.

In various embodiments, when the first surface 591 is viewed from above, the fourth antenna 540 may include a seventh conductive patch 541 disposed in a seventh region 5401 and/or eighth conductive patches 542 disposed in an eighth region 5402 surrounding the seventh region 5401. In an embodiment, the seventh conductive patch 541 may include a seventh feeding point 541*a* and/or an eighth feeding point 541*b*. In an embodiment, the fourth antenna 540 may include at least one fourth conductive wall 543 formed on at least a portion of the outer periphery of the eighth region 5402 when the first surface 591 is viewed from.

In various embodiments, the antenna structure 500 may improve isolation in the operating frequency band and extend the bandwidth through the conductive patches 512, 522, 532 and 542 and/or the conductive walls 513, 523, 533 and 543. In an embodiment, the antenna structure 500 may be operated in the operating frequency band with only the conductive patches 511, 521, 531 and 541. In an embodiment, the antenna structure 500 may include only the first conductive patch 511, the third conductive patch 521, the fifth conductive patch 531, and/or the seventh conductive patch 541 except for the conductive patches 512, 522, 532 and 542 and/or the conductive walls 513, 523, 533 and 543.

In various embodiments, the wireless communication circuit 595 may be configured to transmit and/or receive a first signal of a first polarization through the antenna array AR1 including the first feeding point 511*a*, the third feeding point 521*a*, the fifth feeding point 531*a* and/or the seventh feeding point 541*a*. In an embodiment, the wireless communication circuit 595 may be configured to transmit and/or receive a second signal of a second polarization through the antenna array AR1 including the second feeding point 511*b*, the fourth feeding point 521*b*, the sixth feeding point 531*b* and/or the eighth feeding point 541*b*. In an embodiment, the wireless communication circuit 595 may transmit and/or receive a first signal and a second signal that are identical or not identical to each other in the same frequency band.

Figure 6A:
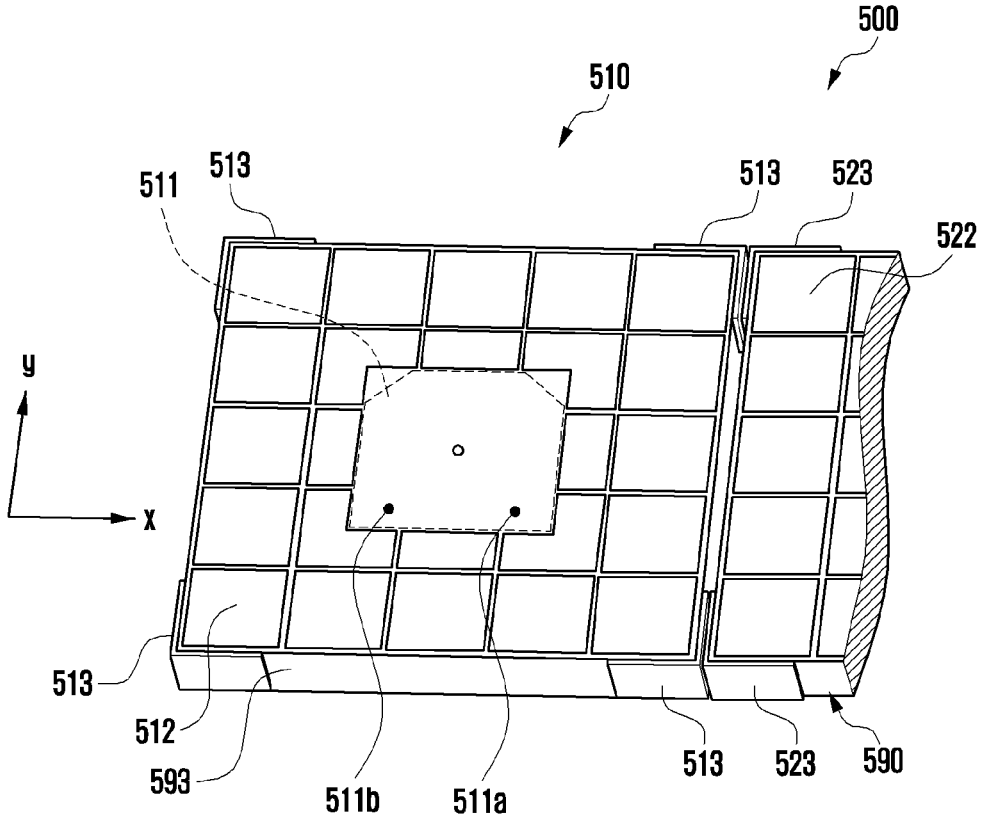
FIG. 6A is a partial perspective view of the antenna structure shown in FIG. 5A according to various embodiments.
Figure 6B:
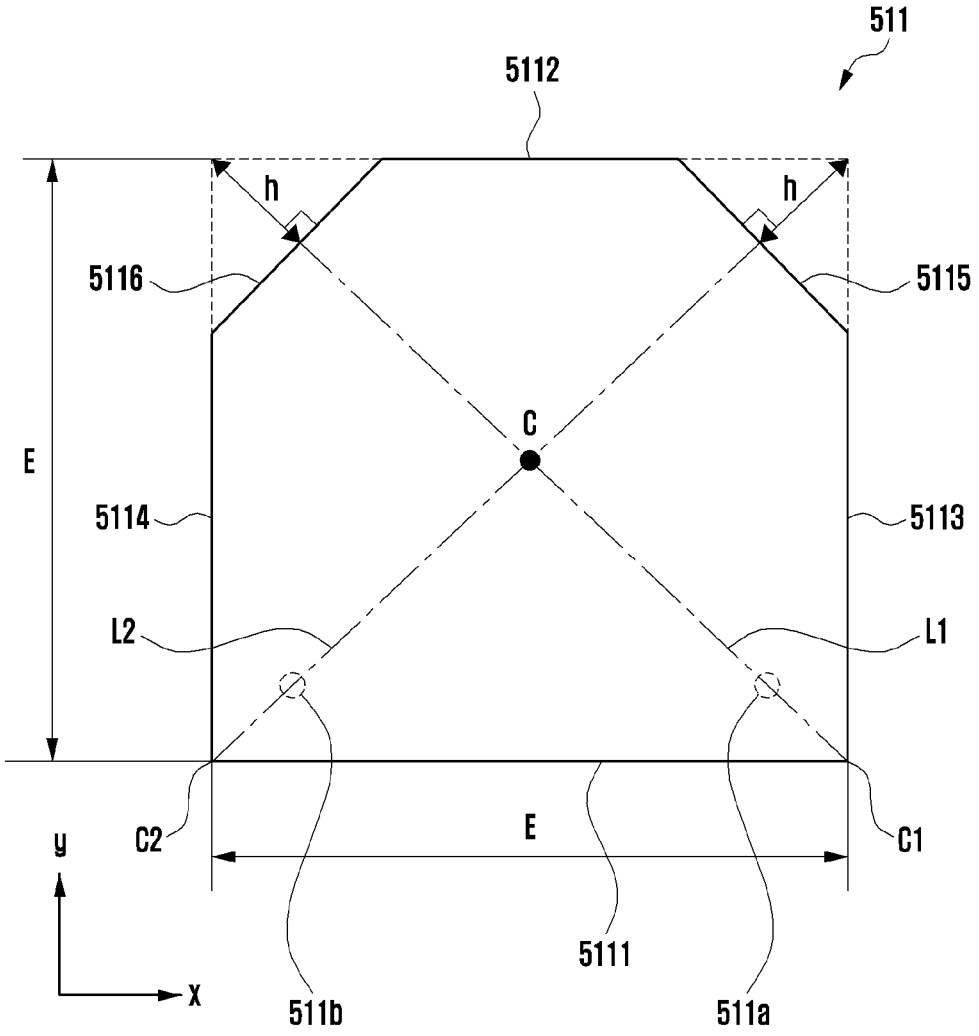
FIG. 6B is a diagram illustrating an example shape of a first conductive patch of the antenna structure shown in FIG. 5A according to various embodiments.

FIG. 6A is a partial perspective view of the antenna structure 500 shown in FIG. 5A according to various embodiments. FIG. 6B is a diagram illustrating an example shape of the first conductive patch 511 of the antenna structure 500 shown in FIG. 5A according to various embodiments.

In FIGS. 6A and 6B, the first conductive patch 511 included in the first antenna 510 of the antenna structure 500 is illustrated and described. As the conductive patch of the second antenna 520, the third antenna 530, or the fourth antenna 540 of the antenna structure 500 may have substantially the same configuration as the first conductive patch 511, a description thereof may not be repeated here.

With reference to FIGS. 6A and 6B, the antenna structure 500 may include a first antenna 510. In an embodiment, the first antenna 510 may include a first conductive patch 511 disposed on the printed circuit board 590. In an embodiment, to implement dual polarization, the first conductive patch 511 may be formed in a shape of an edge cut (e.g., cut-out portion) where adjacent corners are diagonally cut from a square-shaped conductive patch whose four sides are of the same length. In an embodiment, the first conductive patch 511 may include a first side 5111 having a first length, a second side 5112 being spaced apart in parallel with the first side 5111 and having a second length shorter than the first length, a third side 5113 extending vertically from one end of the first side 5111 in a direction toward the second side 5112 (y-axis direction) and having a third length shorter than the vertical distance between the first side 5111 and the second side 5112, a fourth side 5114 extending vertically from the other end of the first side 5111 in the direction toward the second side 5112 (y-axis direction) to have the third length, a fifth side 5115 connecting the third side 5113 and one end of the second side 5112 in a straight line, and a sixth side 5116 connecting the fourth side 5114 and the other end of the second side 5112 in a straight line. In an embodiment, the first feeding point 511*a* may be disposed on a first virtual line L1 passing through the center C of the first conductive patch 511. In an embodiment, the second feeding point 511*b* may be disposed on a second virtual line L2 perpendicular to the first virtual line L1 and passing through the center C of the first conductive patch 511. For example, the first feeding point 511*a* may be disposed, on the first virtual line L1, close to a first corner C1 formed by the first side 5111 and the third side 5113. In an embodiment, the second feeding point 511*b* may be disposed, on the second virtual line L2, close to a second corner C2 formed by the first side 5111 and the fourth side 5114. In this case, the first feeding point 511*a* and the second feeding point 511*b* disposed close to the first corner C1 and the second corner C2 may be connected to the wireless communication circuit (e.g., wireless communication circuit 595 in FIG. 5A) in a manner of direct feeding through the printed circuit board 590. In an embodiment, the first feeding point 511*a* and the second feeding point 511*b* disposed close to the first corner C1 and the second corner C2 may be connected to the wireless communication circuit (e.g., wireless communication circuit 595 in FIG. 5A) in a manner of indirect feeding (capacitively coupled) through the printed circuit board 590. In an embodiment, the first feeding point 511*a* may be disposed between the center C and the sixth side 5116 on the first virtual line L1. For example, the first feeding point 511*a* may be disposed close to the sixth side 5116 between the center C and the sixth side 5116 on the first virtual line L1. In an embodiment, the second feeding point 511*b* may be disposed between the center C and the fifth side 5115 on the second virtual line L2. For example, the second feeding point 511*b* may be disposed close to the fifth side 5115 between the center C and the fifth side 5115 on the second virtual line L2. In an embodiment, when the first feeding point 511*a* and/or the second feeding point 511*b* are disposed close to the sixth side 5116 and/or the fifth side 5115 formed in an edge cut shape, they may be connected to the wireless communication circuit 595 in a manner of indirect feeding (e.g., coupling feed) through the printed circuit board 590.

According to an example embodiment of the disclosure, the edge cut shape obtained by diagonally cutting adjacent corners of the square-shaped first conductive patch 511 (e.g., fifth side 5115 and sixth side 5116) may help to improve isolation against cross polarization and increase the XPD.

Figure 7:
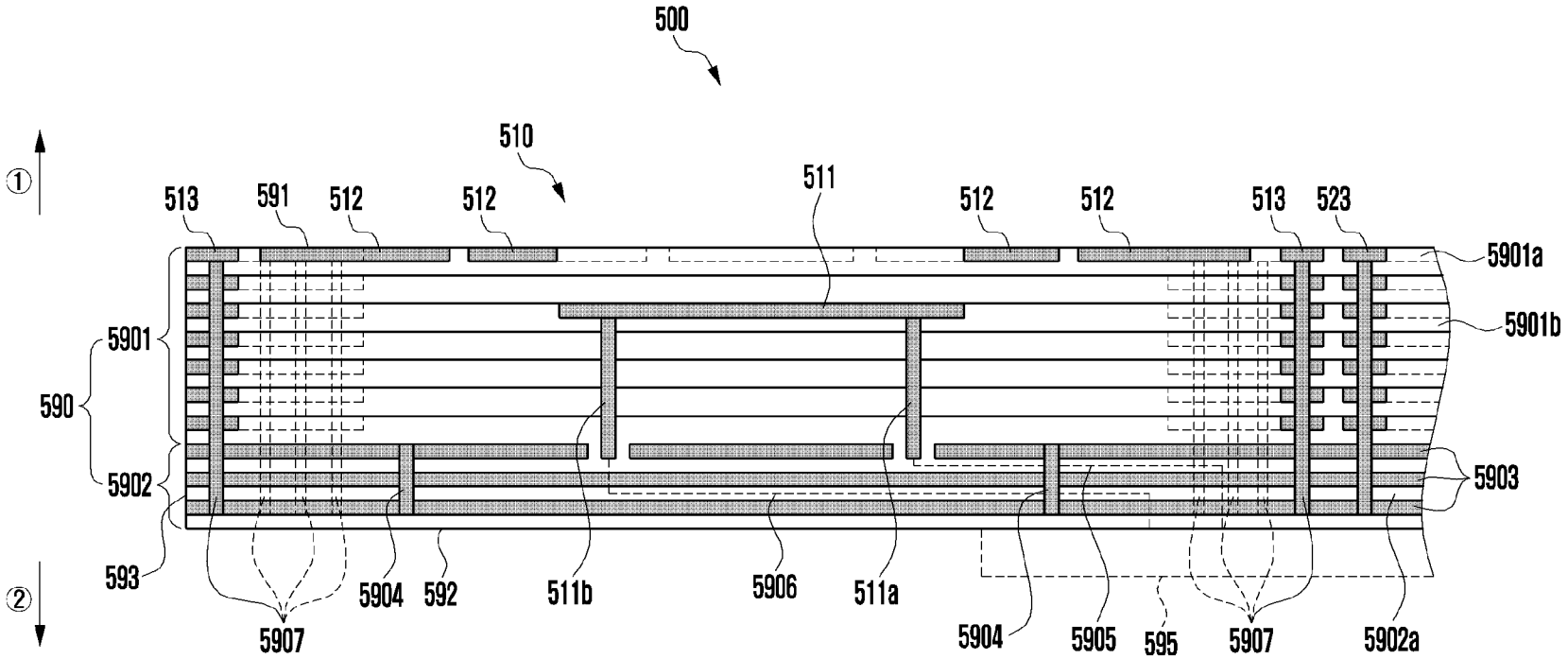
FIG. 7 is a partial cross-sectional view of the antenna structure viewed along the line 7-7 in FIG. 5B according to various embodiments.

FIG. 7 is a partial cross-sectional view of the antenna structure 500 viewed along the line 7-7 in FIG. 5B according to various embodiments.

Although FIG. 7 shows and describes the arrangement of the first antenna 510 of the antenna structure 500 disposed on the printed circuit board 590, the second antenna (e.g., second antenna 520 in FIG. 5B), the third antenna (e.g., third antenna 530 in FIG. 5B) or the fourth antenna (e.g., fourth antenna 540 in FIG. 5B) may also have substantially the same or similar arrangement configuration.

With reference to FIG. 7, the antenna structure 500 may include a printed circuit board 590. In an embodiment, the printed circuit board 590 may include a first surface 591, a second surface 592 facing in a direction opposite to the first surface 591, and a side surface 593 surrounding the space between the first surface 591 and the second surface 592. In an embodiment, the printed circuit board 590 may include a plurality of insulating layers. In an embodiment, the printed circuit board 590 may include a first layer region 5901 including at least one insulating layer, and a second layer region 5902 adjacent to the first layer region 5901 and including at least one other insulating layer. In an embodiment, the first layer region 5901 may include the first antenna 510. In an embodiment, the second layer region 5902 may include at least one ground layer 5903. In an embodiment, the ground layers 5903 may be disposed on plural insulating layers in the second layer region 5902 and may be electrically connected to each other through conductive vias 5904.

In various embodiments, the first antenna 510 may include a first conductive patch 511 disposed in the first layer region 5901. In an embodiment, the first conductive patch 511 may be disposed on one insulating layer 5901*b* of the first layer region 5901. In an embodiment, the first conductive patch 511 may be disposed closer to the first surface 591 than the second surface 592 inside the first layer region 5901. In an embodiment, the first conductive patch 511 may be disposed to be exposed to the first surface 591 in the first layer region 5901. In an embodiment, the first antenna 510 may include a first feeding point 511*a* and a second feeding point 511*b* that are electrically connected to the first conductive patch 511 at positions spaced apart from each other. In an embodiment, the first feeding point 511*a* and the second feeding point 511*b* may include a conductive via disposed to penetrate the first layer region 5901 in the thickness direction of the printed circuit board 590. In an embodiment, the first feeding point 511*a* may be electrically connected to the wireless communication circuit 595 through a first feed line 5905 disposed in the second layer region 5902. In an embodiment, the second feeding point 511*b* may be electrically connected to the wireless communication circuit 595 through a second feed line 5906 disposed in the second layer region 5902. In an embodiment, the first feed line 5905 and the second feed line 5906 may be formed to be electrically disconnected from the ground layers 593 disposed in the second layer region 5902.

In various embodiments, the first antenna 510 may include second conductive patches 512 that are disposed to be exposed to the first surface 591 in the first layer region 5901. In an embodiment, the second conductive patches 512 may be disposed closer to the first surface 591 than the first conductive patch 511. In an embodiment, the second conductive patches 512 may be arranged so as not to overlap the first conductive patch 511 when the first surface 591 is viewed from above. In an embodiment, if the second conductive patches 512 and the first conductive patch 511 are disposed on different insulating layers 5901*a*, the second conductive patches 512 may be disposed to at least partially overlap the first conductive patch 511 when the first surface 591 is viewed from above.

In various embodiments, the first antenna 510 may include at least one first conductive wall 513 extending from the first surface 591 to the second surface 592 in the first layer region 5901. In an embodiment, the at least one first conductive wall 513 may be disposed around the second conductive patches 512 at a position couplable thereto. The second antenna (e.g., second antenna 520 in FIG. 5) may include a second conductive wall 523. In an embodiment, the at least one first conductive wall 513 may be disposed to be electrically disconnected from the second conductive patches 512. In an embodiment, the at least one conductive wall 513 may include a conductive via 5907 that passes through the insulating layers in the first layer region 5901 while being electrically connected to plural conductive members disposed on the neighboring insulating layers. In an embodiment, the at least one conductive wall 513 may be disposed to be electrically connected to at least one ground layer 5903 in the second layer region 5902.

Figure 8A:
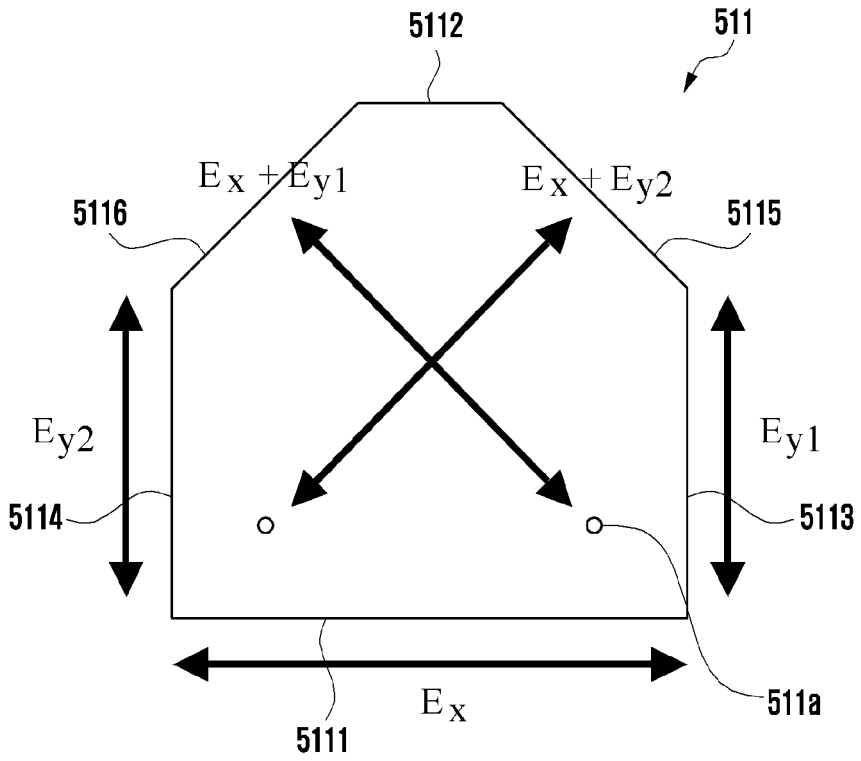
FIGS. 8A and 8B are diagrams illustrating principle for improving cross-polarization discrimination (XPD) characteristics of the antenna according to various embodiments.
Figure 8B:
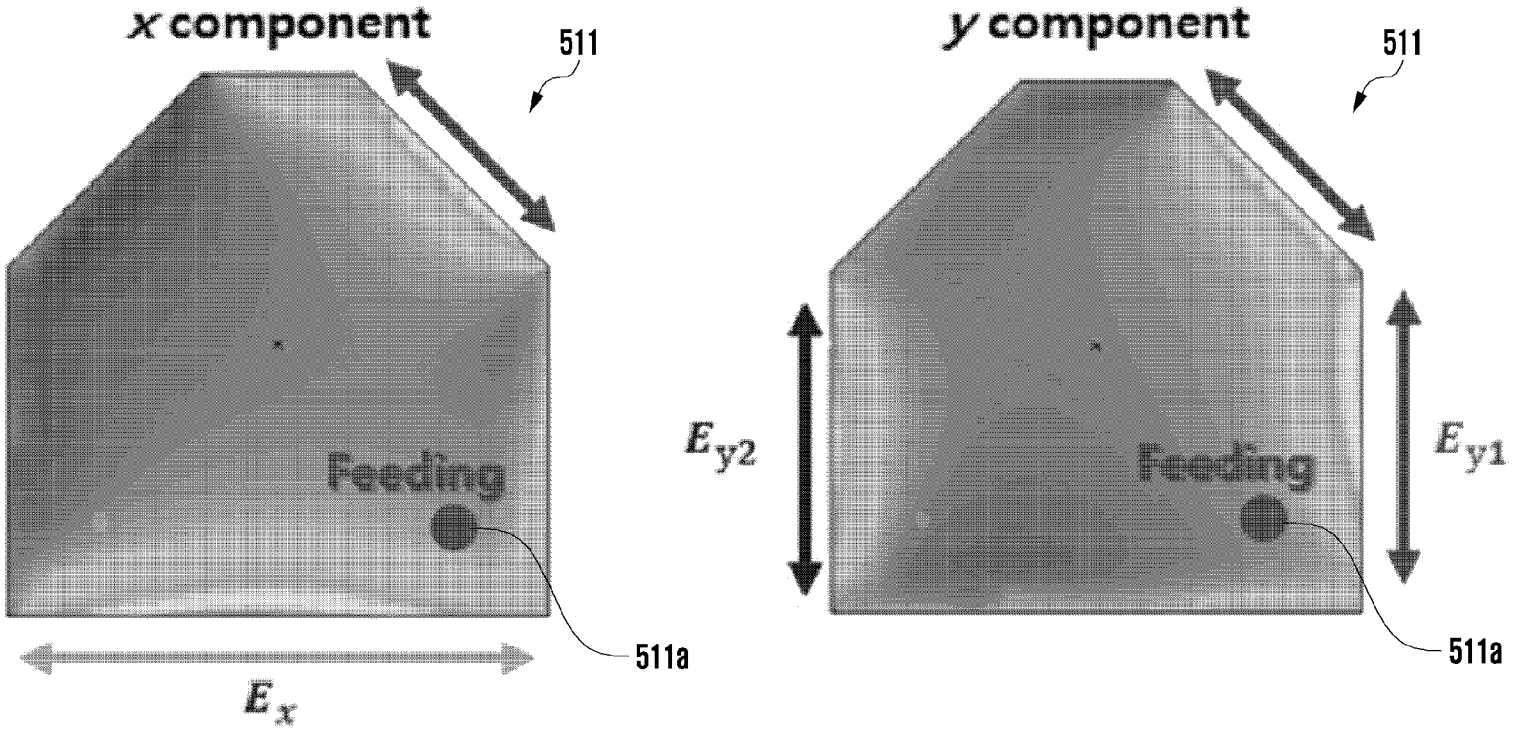

FIG. 8A and FIG. 8B are diagrams illustrating an example principle for improving cross-polarization discrimination (XPD) characteristics of the antenna according to various embodiments.

FIGS. 8A and 8B show the principle of XPD enhancement in the first conductive patch 511 having ±45 degree polarization. In an embodiment, for the first conductive patch, slant polarization may be given by the sum of Ex and Ey components. In an embodiment, when the first feeding point 511*a* causing −45 degree polarization is fed, the main polarization component becomes Ex+Ey1, and the cross polarization component Ex+Ey2 may cause deterioration of the polarization isolation characteristic. Considering the surface current distribution (maximum surface current) shown in FIG. 8B, as the component Ey2 in the first conductive patch 511 to which the edge-cut is applied may have a value smaller than that of a regular square, polarization isolation characteristics and XPD characteristics can be improved.

Figure 9:
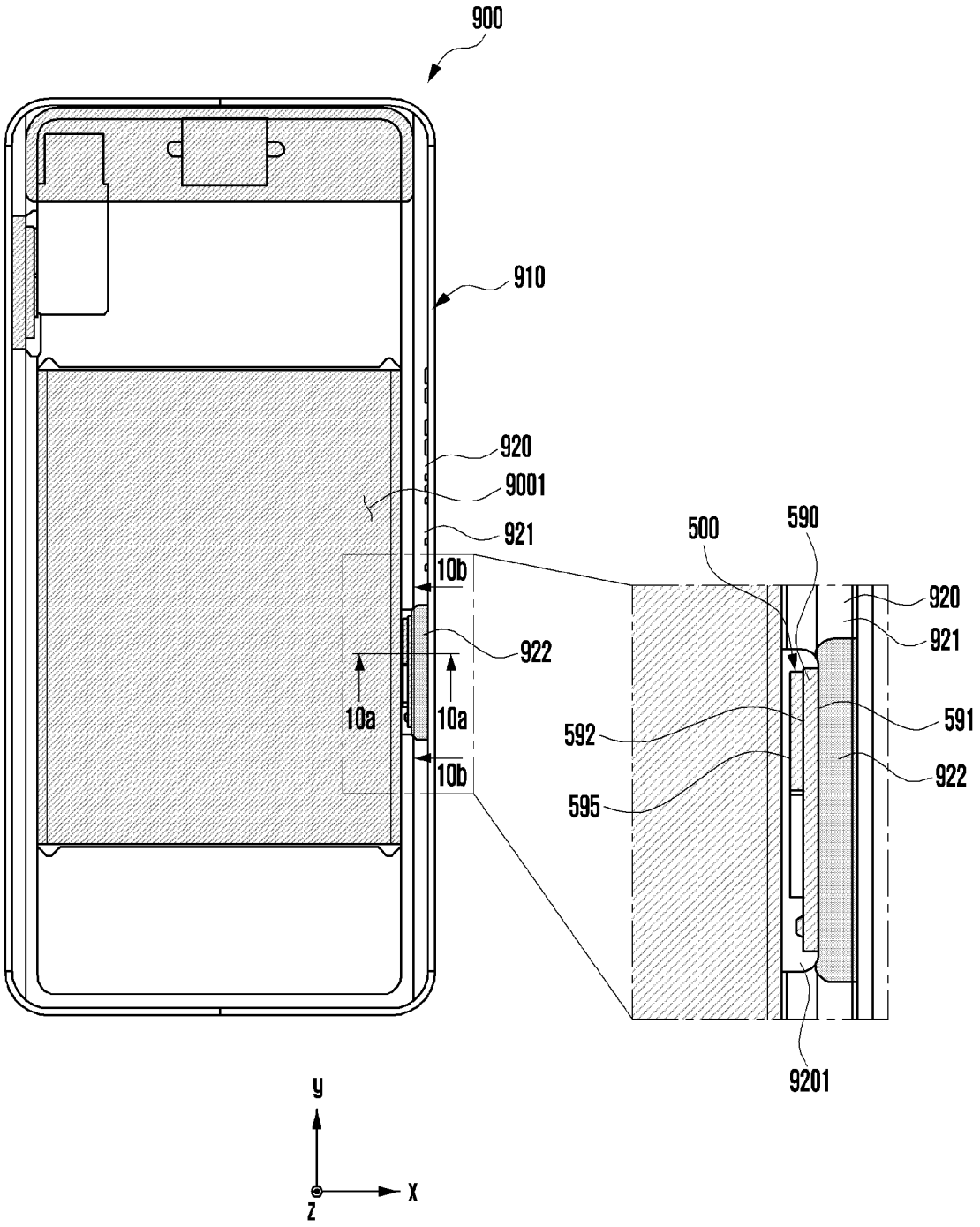
FIG. 9 is a diagram illustrating an example state in which the antenna structure is mounted on an electronic device according to various embodiments.

FIG. 9 is a diagram illustrating an example state in which the antenna structure 500 is mounted on an electronic device 900 according to various embodiments.

The electronic device 900 of FIG. 9 may be at least partially similar to the electronic device 101 of FIG. 1 or the electronic device 300 of FIG. 3A, or may further include other embodiments of an electronic device.

With reference to FIG. 9, the electronic device 900 may include a housing 910 that includes a front cover (e.g., front cover 930 in FIG. 10A) facing in a first direction (e.g., negative Z direction in FIG. 10A), a rear cover (e.g., rear cover 940 in FIG. 10A) facing in a direction opposite to the front cover 930 (e.g., Z direction in FIG. 10A), and a side member (e.g., bezel, side wall, side frame or side surface) 920 surrounding the space 9001 between the front cover 930 and the rear cover 940. In an embodiment, the electronic device 900 may include a display (e.g., display 931 in FIG. 10A) disposed to be visible from the outside through the front cover 930. In an embodiment, the side member 920 may include a conductive portion 921 that is at least partially disposed and a non-conductive portion 922 (e.g., polymer portion) coupled to the conductive portion 921. In an embodiment, the non-conductive portion 922 may be replaced with a space or other dielectric material.

In various embodiments, the printed circuit board 590 of the antenna structure 500 may be mounted in the internal space 9001 of the electronic device 900 so that the conductive patches (e.g., conductive patches 511, 521, 531 and 541 in FIG. 10B) face the side member 920. For example, the antenna structure 500 may be mounted on the module mounting portion 9201 provided in the side member 920 so that the first surface 591 of the printed circuit board 590 faces the side member 920. In an embodiment, the non-conductive portion 922 may be disposed in at least some of the side member 920 facing the antenna structure 500 so that a beam pattern is formed in a direction in which the side member 920 faces (in the direction of the arrow in FIG. 10A).

Figure 10A:
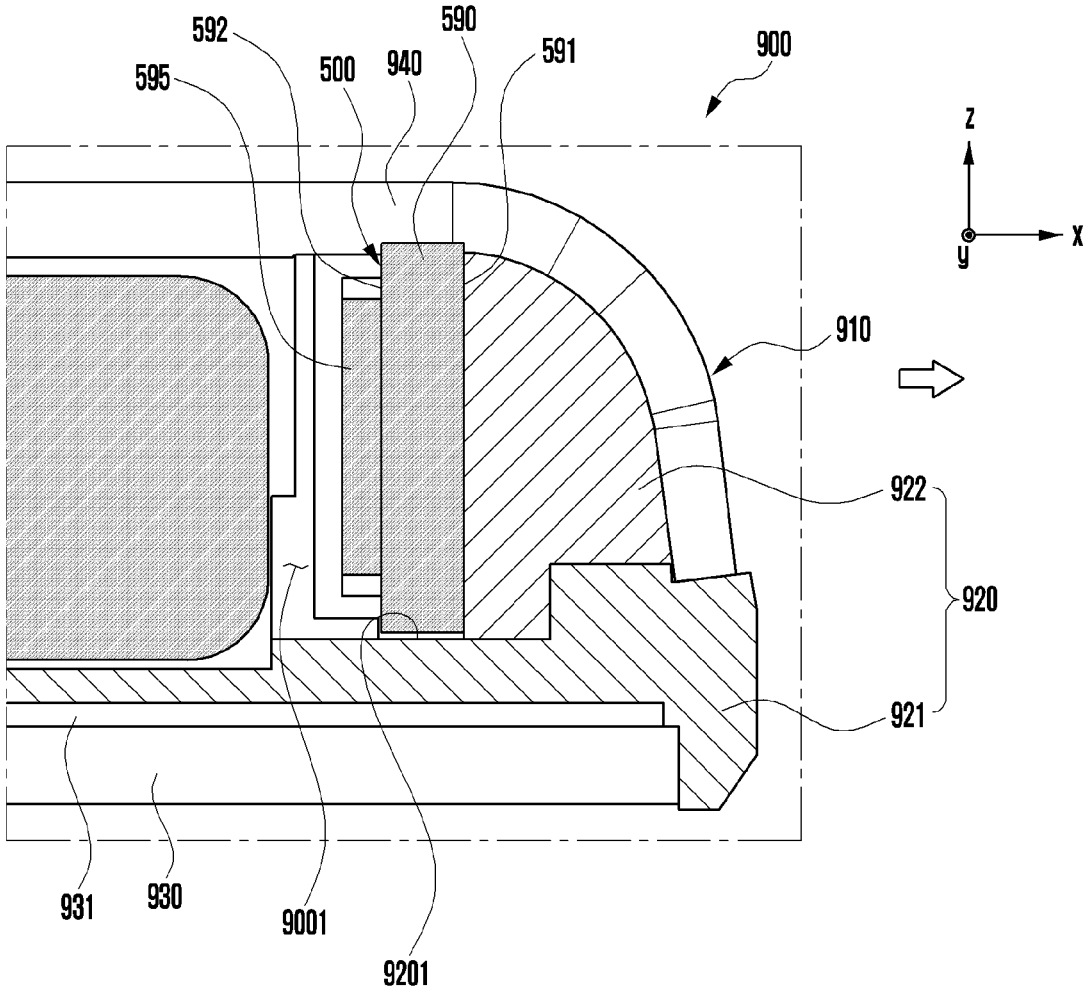
FIG. 10A is a partial cross-sectional view of the electronic device viewed from the line 10*a*-10*a* in FIG. 9 according to various embodiments.
Figure 10B:
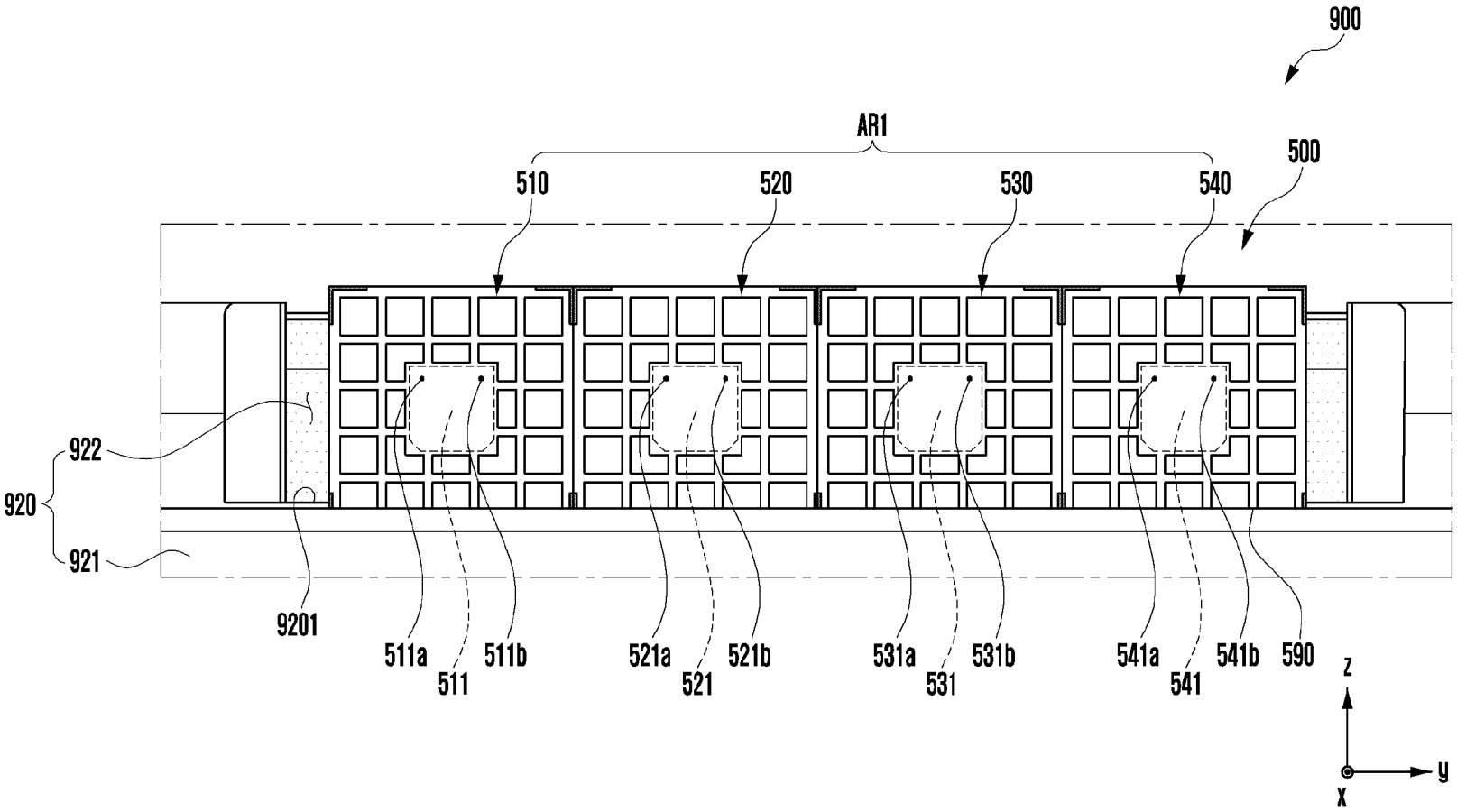
FIG. 10B is a partial cross-sectional view of the electronic device viewed from the line 10*b*-10*b* in FIG. 9 according to various embodiments.

FIG. 10A is a partial cross-sectional view of the electronic device 900 viewed from the line 10*a*-10*a* in FIG. 9 according to various embodiments. FIG. 10B is a partial cross-sectional view of the electronic device 900 viewed from the line 10*b*-10*b* in FIG. 9 according to various embodiments. FIG. 10B is a view in which the antenna structure 500 is visible from the outside of the side member 920 with the non-conductive portion 922 omitted.

With reference to FIGS. 10A and 10B, the antenna structure 500 may be mounted on the module mounting portion 9201 of the side member 920 so that substantially most of the antenna structure 500 overlaps the non-conductive portion 922 when the antenna array AR1 views the side member 920 from the outside. In an embodiment, the antenna structure 500 may be mounted on the module mounting portion 9201 so as to at least partially include a region overlapping the conductive portion 921 when the antenna array AR1 views the side member 920 from the outside. This is to reduce an increase in the thickness of the electronic device 900 due to the mounting of the antenna structure 500 and to firmly mount the printed circuit board 590 on the side member 920.

In various embodiments, the radiation characteristics of the antenna structure 500 may be varied according to the separation distance to the conductive portion 921 and/or the degree of overlap with the conductive portion 921. Hence, to reduce deterioration of radiation characteristics, the feeding points 511*a*, 511*b*, 521*a*, 521*b*, 531*a*, 531*b*, 541*a*, 541*b* formed on the conductive patches 511, 521, 531 and 541 arranged on the printed circuit board may be disposed as far as possible in distance from the conductive portion 922. In an embodiment, when the side member 920 is viewed from the outside, the feeding points 511*a*, 511*b*, 521*a*, 521*b*, 531*a*, 531*b*, 541*a*, 541*b* may be disposed at positions not overlapping the conductive portion 921.

Figure 11A:
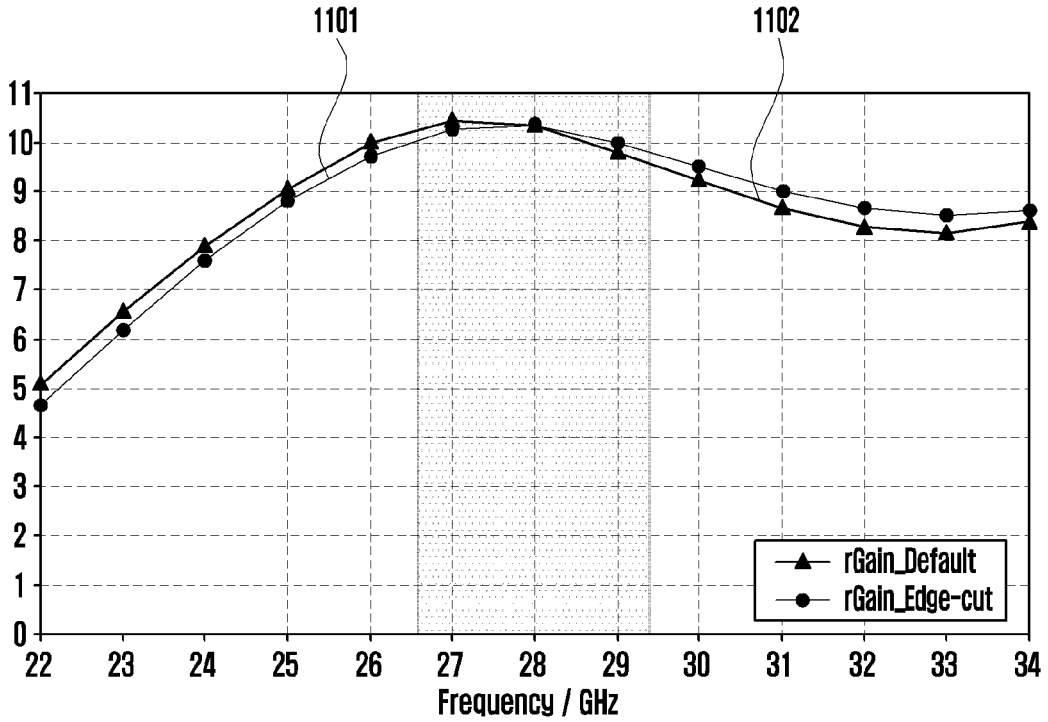
FIGS. 11A and 11B are graphs illustrating a result of comparison between an antenna structure to which edge cut is applied and an antenna structure to which edge cut is not applied in terms of gain characteristics and XPD characteristics according to various embodiments.
Figure 11B:
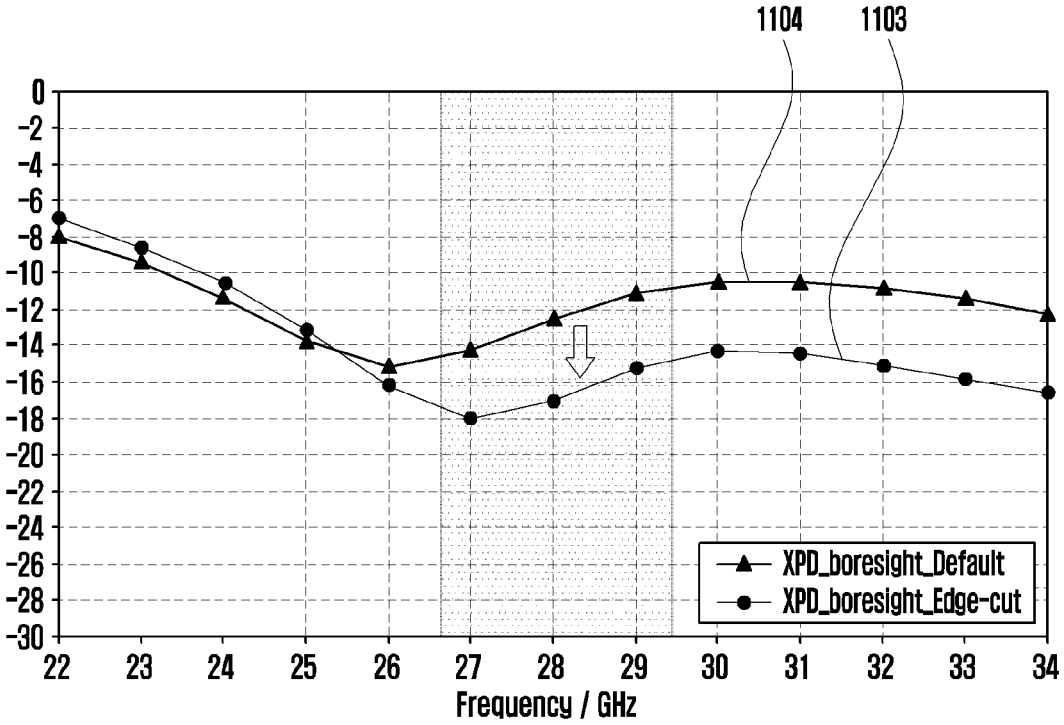

FIGS. 11A and 11B are graphs illustrating an example comparison between the antenna structure 500 to which edge cut is applied and an antenna structure to which edge cut is not applied in terms of gain characteristics and XPD characteristics according to various embodiments.

It can be seen from FIG. 11A that, in a first frequency band (e.g., about 29.5 GHz band), the gain characteristic of the antenna structure 500 to which edge cut is applied according to an example embodiment of the disclosure (graph 1101) is better than that of the antenna structure to which edge cut is not applied (graph 1102).

It can be seen from FIG. 11B that, in the first frequency band (e.g., about 29.5 GHz band), the XPD characteristic of the antenna structure 500 to which edge cut is applied according to an example embodiment of the disclosure (graph 1103) is higher than that of the antenna structure to which edge cut is not applied (graph 1104) by about 4 dB or more. Hence, it is possible to improve polarization diversity gain of the antenna structure 500 through XPD improvement based on the edge cut shape.

Figure 12A:
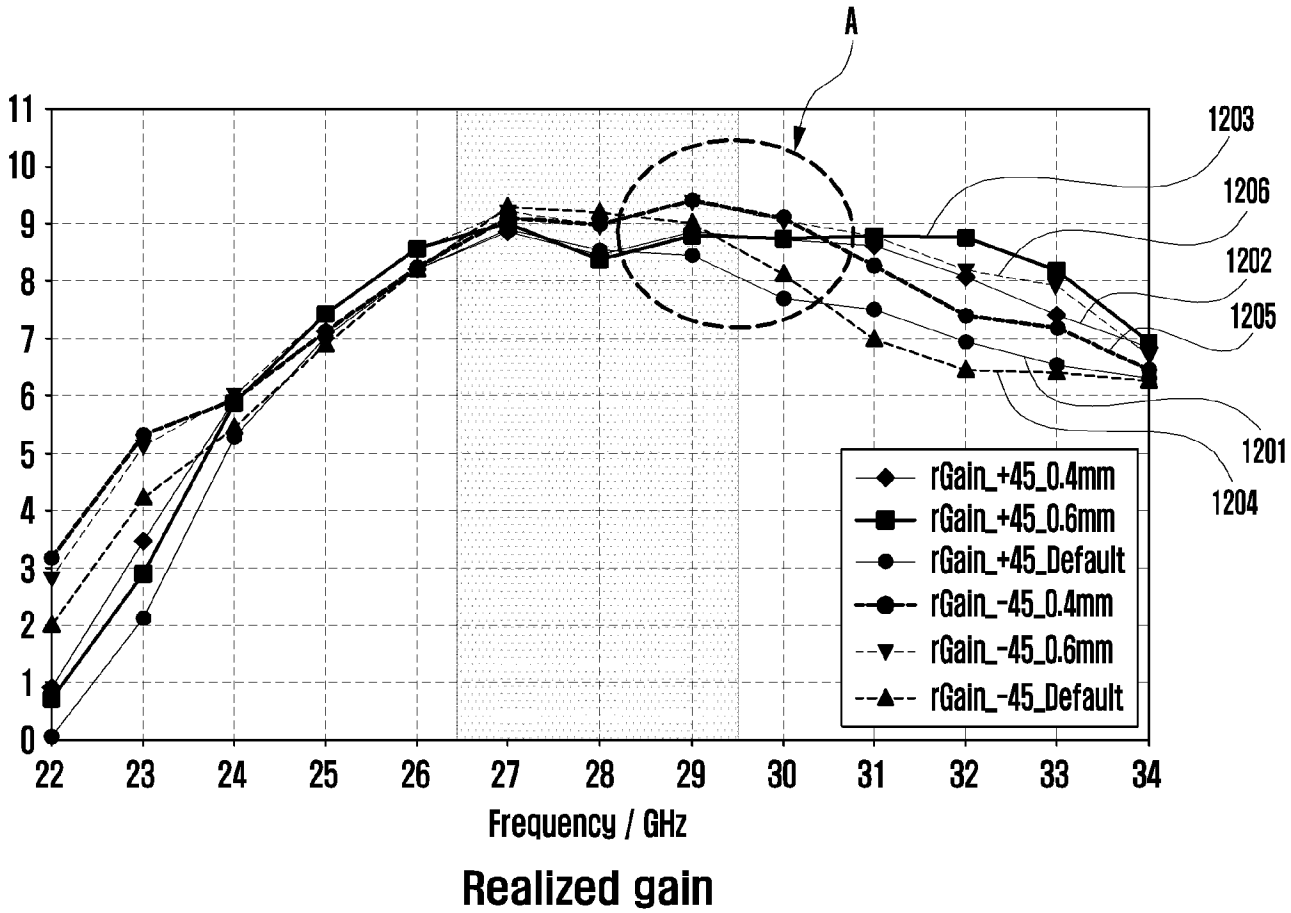
FIGS. 12A and 12B are graphs illustrating example changes in gain characteristics and XPD characteristics of the antenna structure depending on the degree of edge cut according to various embodiments.
Figure 12B:
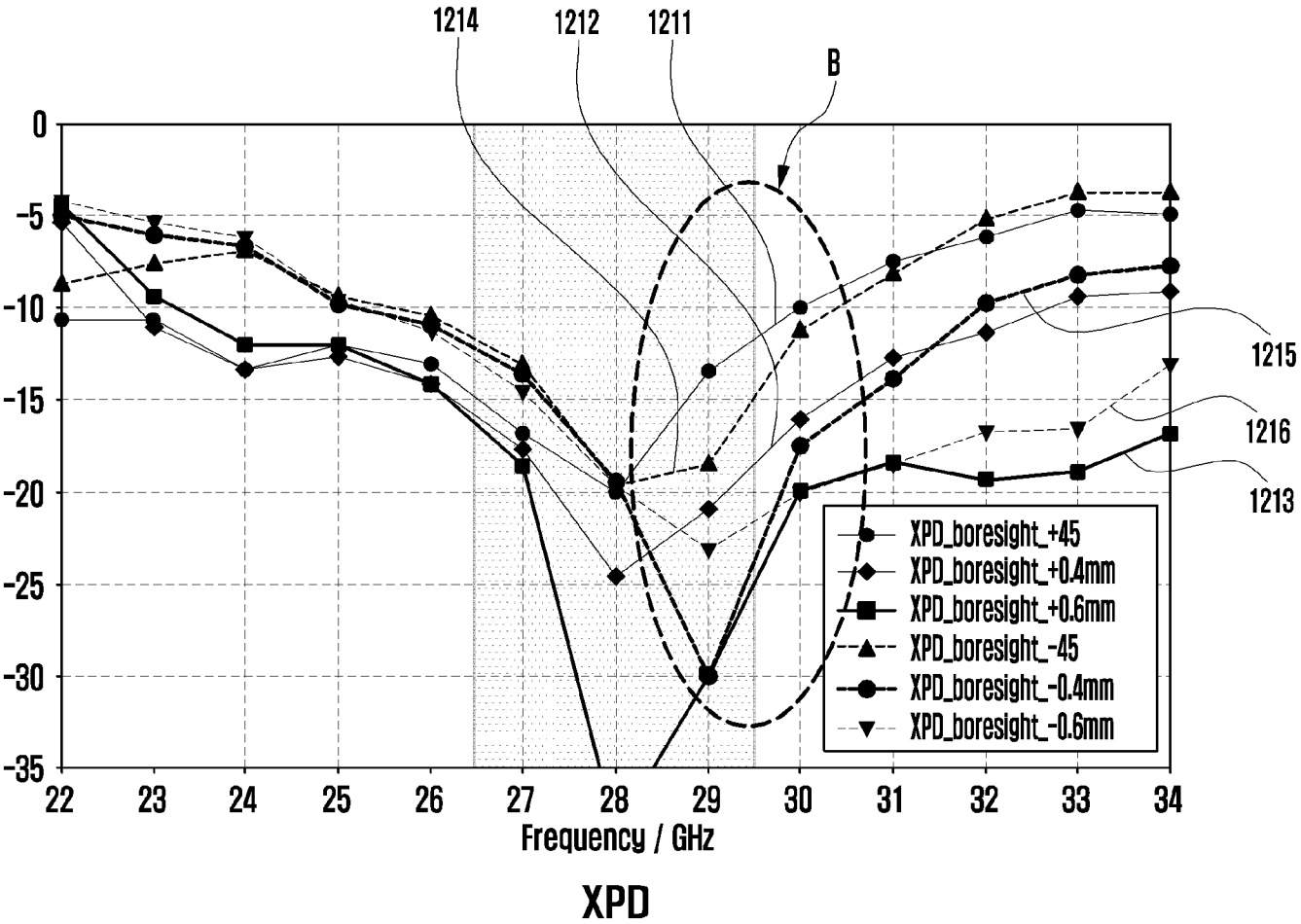

FIGS. 12A and 12B are graphs illustrating example changes in gain characteristics and XPD characteristics of the antenna structure depending on the degree of edge cut according to various embodiments.

In various embodiments, the XPD characteristics of the antenna structure may be changed according to the vertical distance (e.g., vertical distance h in FIG. 6B) from the corner of the square-shaped conductive patch (e.g., first conductive patch 511 of FIG. 6B) before the edge cut to the side cut diagonally (e.g., fifth side 5115 or sixth side 5116 in FIG. 6B).

With reference to FIG. 12A, for the antenna structure having a polarization characteristic of +45 (e.g., antenna structure 500 in FIG. 5A), it can be seen that, in the first frequency band (e.g., about 29.5 GHz band) (indicated by 'A' in FIG. 12A), compared to the gain characteristic of the antenna structure to which edge cut is not applied (graph 1201), the gain characteristic of the antenna structure to which edge cut is applied with a vertical distance of 0.4 mm (e.g., vertical distance h in FIG. 6B) (graph 1202) is improved, and the gain characteristic of the antenna structure to which edge cut is applied with a vertical distance of 0.6 mm (e.g., vertical distance h in FIG. 6B) (graph 1203) is further improved.

In various embodiments, for the antenna structure having a polarization characteristic of −45, it can be seen that, in the first frequency band (e.g., about 29.5 GHz band) (indicated by 'A' in FIG. 12A), compared to the gain characteristic of the antenna structure to which edge cut is not applied (graph 1204), the gain characteristic of the antenna structure to which edge cut is applied with a vertical distance of 0.4 mm (e.g., vertical distance h in FIG. 6B) (graph 1205) is improved, and the gain characteristic of the antenna structure to which edge cut is applied with a vertical distance of 0.6 mm (e.g., vertical distance h in FIG. 6B) (graph 1206) is further improved.

With reference to FIG. 12B, for the antenna structure having a polarization characteristic of +45, it can be seen that, in the first frequency band (e.g., about 29.5 GHz band) (indicated by 'B' in FIG. 12B), compared to the XPD characteristic of the antenna structure to which edge cut is not applied (graph 1211), the XPD characteristic of the antenna structure to which edge cut is applied with a vertical distance of 0.4 mm (e.g., vertical distance h in FIG. 6B) (graph 1212) is improved, and the XPD characteristic of the antenna structure to which edge cut is applied with a vertical distance of 0.6 mm (e.g., vertical distance h in FIG. 6B) (graph 1213) is further improved. For example, it can be seen that the XPD characteristic is improved by about 10 dB or more through the edge cut configuration.

In various embodiments, for the antenna structure having a polarization characteristic of −45, it can be seen that, in the first frequency band (e.g., about 29.5 GHz band) (indicated by 'B' in FIG. 12B), compared to the XPD characteristic of the antenna structure to which edge cut is not applied (graph 1214), the XPD characteristic of the antenna structure to which edge cut is applied with a vertical distance of 0.4 mm (e.g., vertical distance h in FIG. 6B) (graph 1215) is improved, and the XPD characteristic of the antenna structure to which edge cut is applied with a vertical distance of 0.6 mm (e.g., vertical distance h in FIG. 6B) (graph 1216) is further improved.

Figure 13:
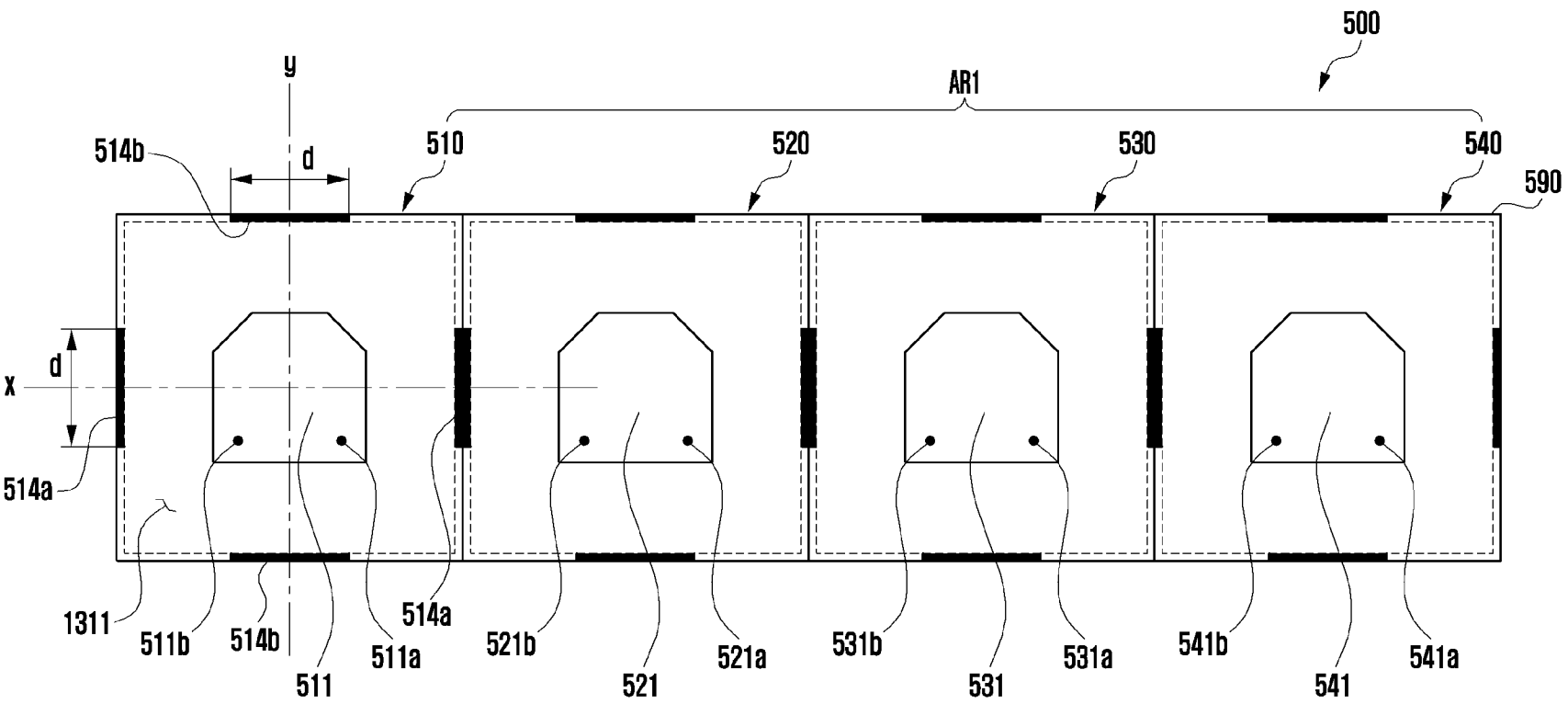
FIG. 13 is a diagram illustrating an example configuration of an antenna structure according to various embodiments.

FIG. 13 is a diagram illustrating an example configuration of an antenna structure 500 according to various embodiments.

The antenna structure 500 of FIG. 13 may be at least partially similar to the antenna structure 500 of FIG. 5B, or may further include other embodiments.

With reference to FIG. 13, the antenna structure 500 may include a first antenna 510, a second antenna 520, a third antenna 530, and a fourth antenna 540, which are disposed at regular intervals on the printed circuit board 590.

In various embodiments, the first antenna 510 may include a first conductive patch 511 that has the same shape as the initial one even if rotated by 90 degrees, 180 degrees or 270 degrees around the intersection of the x-axis and the y-axis perpendicular to each other and includes a first feeding point 511*a* and a second feeding point 511*b* disposed at positions symmetrical with respect to the y-axis, a first arrangement region 1311 including second conductive patches (e.g., second conductive patches 512 in FIG. 5B) that surround the first conductive patch 511 and have the same arrangement shape as the initial one even if rotated 90 degrees, 180 degrees, or 270 degrees around the above intersection, and first conductive sidewalls 514*a* and 514*b* at least partially disposed along the periphery of the first arrangement region 1311. In an embodiment, the first conductive sidewalls 514*a* and 514*b* may include left-right conductive sidewalls 514*a* disposed at the left and right edges of the first arrangement region 1311 and upper-lower conductive sidewalls 514*b* disposed at the upper and lower edges of the first arrangement region 1311. In an embodiment, the first conductive sidewalls 514*a* and 514*b* may have the same arrangement structure as the initial one even if they are rotated by 90 degrees, 180 degrees, or 270 degrees around the intersection described above. In an embodiment, the first conductive sidewalls 514*a* and 514*b* may be electrically connected to the ground layers (e.g., ground layers 5903 in FIG. 7) of the printed circuit board 590, and may be disposed to be electrically insulated from the second conductive patches (e.g., second conductive patches 512 in FIG. 5B). In an embodiment, the second antenna 520, the third antenna 530, or the fourth antenna 540 may have substantially the same configuration as the first antenna 510.

In various embodiments, the antenna structure 500 may provide a vertically and horizontally symmetrical ground condition through the first conductive sidewalls 514*a* and 514*b* disposed at the edges of the first arrangement region 1311, so that XPD characteristics may be improved. In an embodiment, isolation characteristics between ports connected respectively to corresponding feeding parts (polarization isolation) and XPD characteristics may have a trade-off relationship according to a change in length d of the first conductive sidewalls 514*a* and 514*b*. For example, if the length d of the left-right conductive sidewalls 514*a* among the first conductive sidewalls 514*a* and 514*b* is shortened, the XPD characteristics may be improved, but the isolation characteristics between ports connected respectively to corresponding feeding parts may be deteriorated. As another example, if the length d of the upper-lower conductive sidewalls 514*b* among the first conductive sidewalls 514*a* and 514*b* is shortened, the XPD characteristics may be improved, but the isolation characteristics between ports connected respectively to corresponding feeding parts may be deteriorated. Hence, appropriate adjustment of the length of the first conductive sidewalls 514*a* and 514*b* may contribute to both improving the XPD characteristics of the antenna structure 500 and preventing and/or reducing deterioration of the isolation characteristics between ports connected respectively to corresponding feeding parts.

Figure 14A:
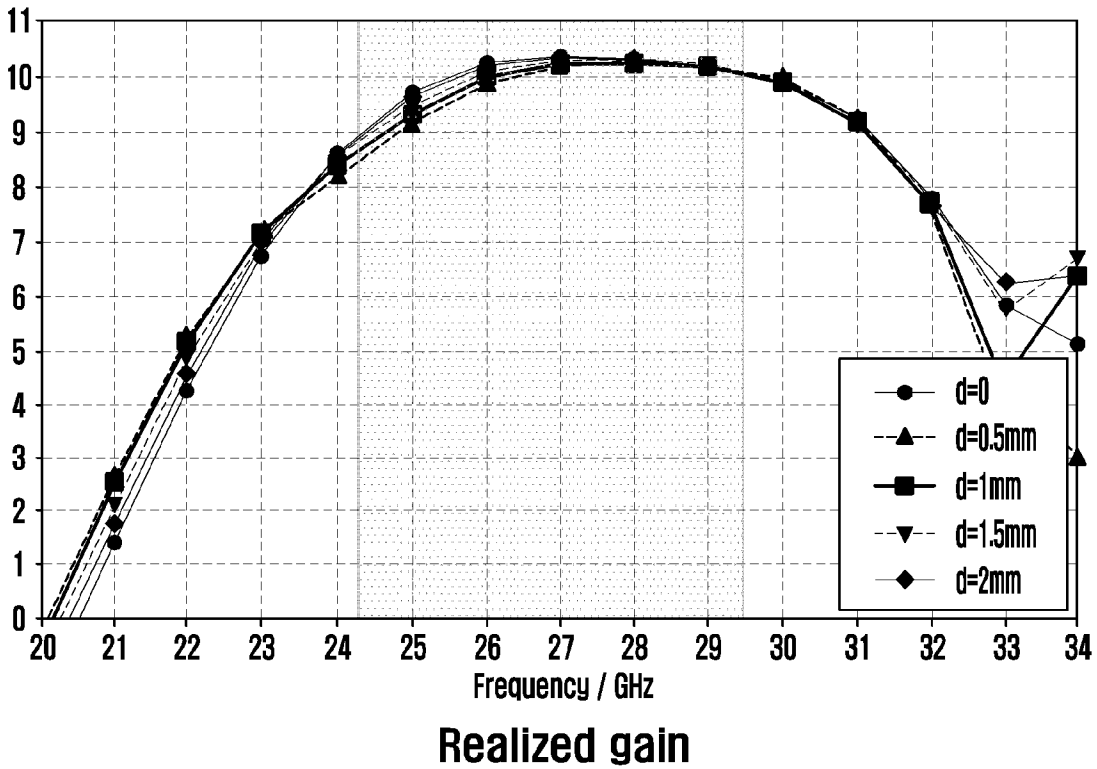
FIGS. 14A and 14B are graphs illustrating example changes in gain characteristics and XPD characteristics depending on the length of conductive walls in the antenna structure of FIG. 13 according to various embodiments.
Figure 14B:
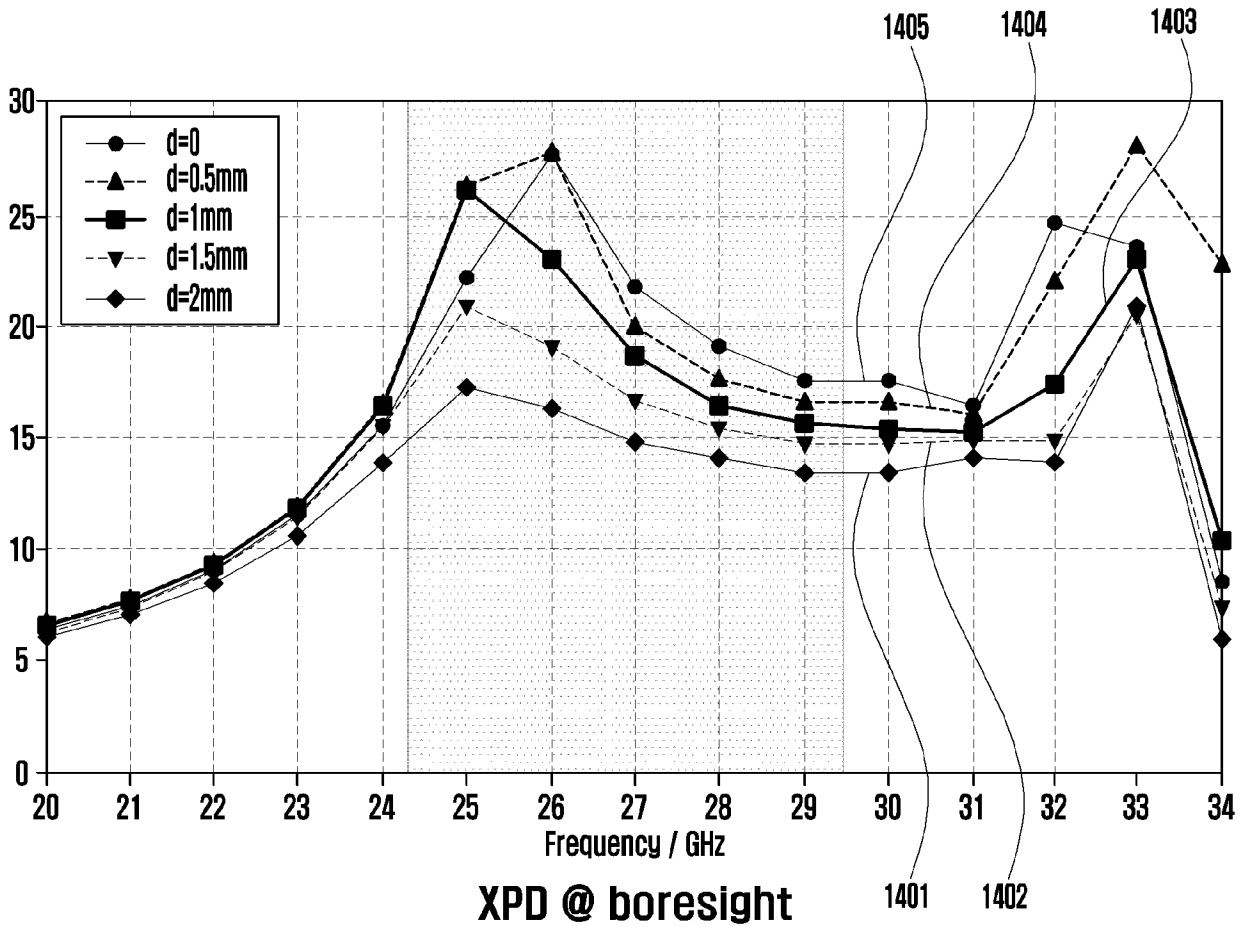

FIGS. 14A and 14B are graphs illustrating example changes in gain characteristics and XPD characteristics depending on the length of the conductive sidewalls 514*a* and 514*b* in the antenna structure 500 of FIG. 13 according to various embodiments.

With reference to FIG. 14A, it can be seen that, in the first frequency band (e.g., about 29.5 GHz), the gain characteristic of the antenna structure 500 is substantially unchanged even if the length d of the conductive sidewalls 514*a* and 514*b* changes to 2 mm, 1.5 mm, 1 mm, 0.5 mm, or 0 mm.

With reference to FIG. 14B, it can be seen that, in the first frequency band (e.g., about 29.5 GHz), the XPD characteristic of the antenna structure 500 is gradually improved when the length d of the conductive sidewalls 514*a* and 514*b* changes to 2 mm (graph 1401), 1.5 mm (graph 1402), 1 mm (graph 1403), 0.5 mm (graph 1404), or 0 mm (graph 1405). Hence, the antenna structure 500 may be adjusted to improve the XPD characteristic without deteriorating the gain characteristic by changing the length d of the conductive sidewalls 514*a* and 514*b*. For example, as the polarization isolation characteristic and the XPD characteristic are in a trade-off relationship, if the length is set to a value (e.g., 1.5 mm) so that the XPD characteristic satisfies a specific criterion (e.g., about 15 dB), deterioration of the gain characteristic can also be prevented and/or reduced.

In various embodiments, the conductive sidewalls 514*a* and 514*b* may be applied to an antenna structure including at least one conductive patch 511, 521, 531 and 541 only.

Figure 15:
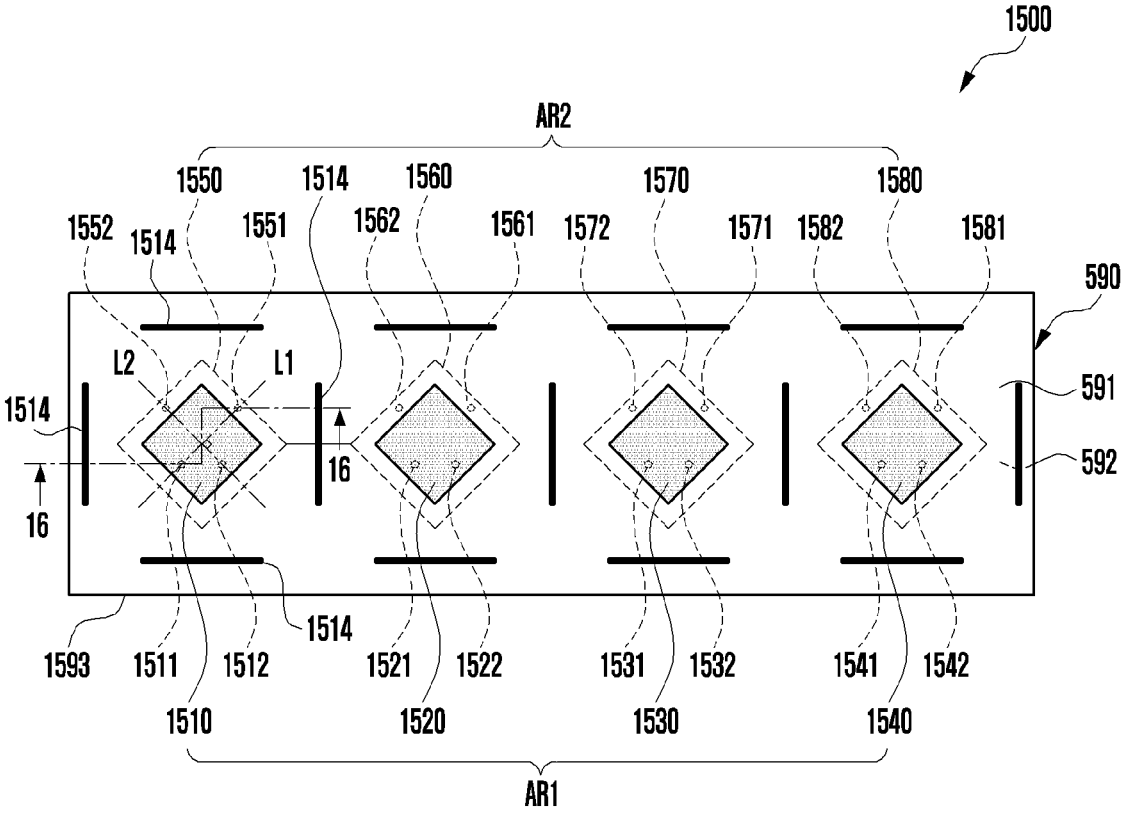
FIG. 15 is a diagram illustrating an example configuration of an antenna structure according to various embodiments.
Figure 16:
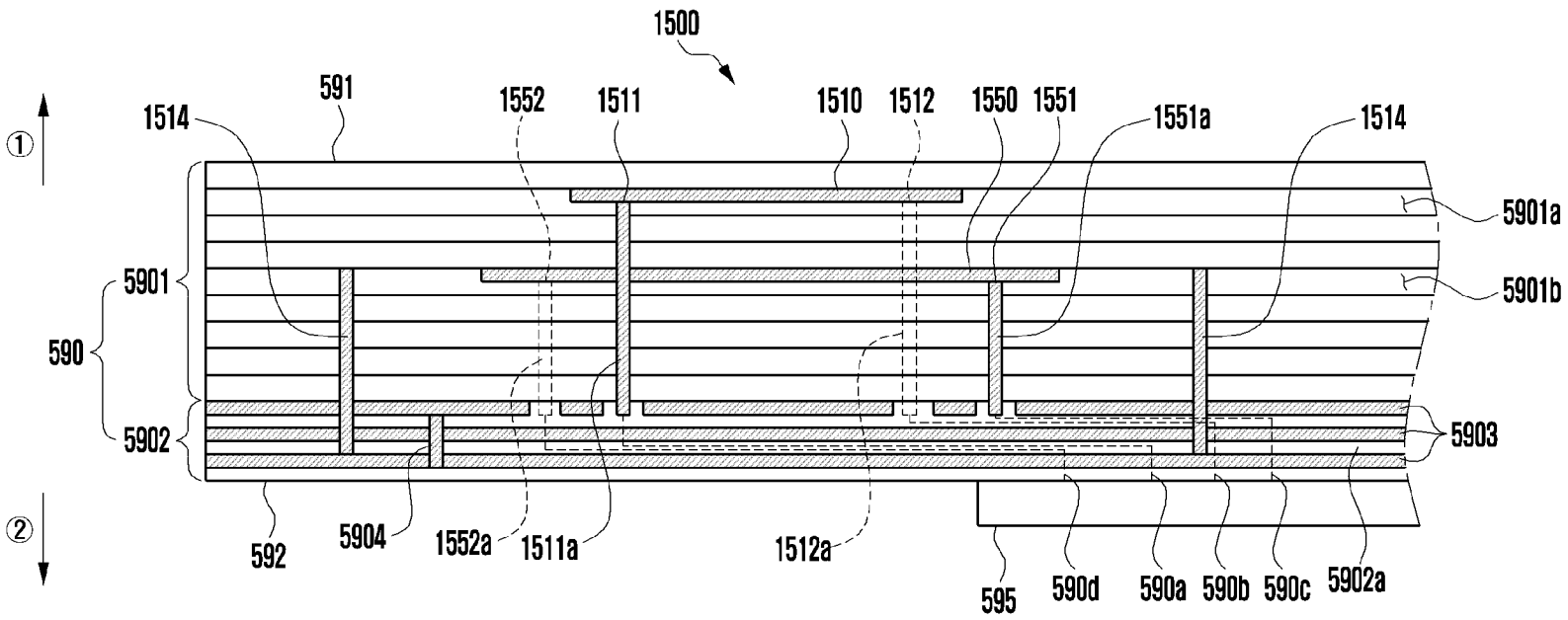
FIG. 16 is a partial cross-sectional view of the antenna structure viewed along the line 16-16 in FIG. 15 according to various embodiments.

FIG. 15 is a diagram illustrating an example configuration of an antenna structure 1500 according to various embodiments. FIG. 16 is a partial cross-sectional view of the antenna structure 1500 viewed along the line 16-16 in FIG. 15 according to various embodiments.

In various embodiments, the antenna structure 1500 including at least one conductive patch to which edge cut is not applied may also have improved XPD characteristics through the conductive sidewalls 1514.

The antenna structure 1500 of FIGS. 15 and 16 may be at least partially similar to the third antenna module 246 in FIG. 2, or may further include an embodiment of an antenna structure.

With reference to FIGS. 15 and 16, the antenna structure 1500 may include a printed circuit board 590, a first antenna array AR1 including plural first conductive patches 1510, 1520, 1530 and 1540, and/or a second antenna array AR2 including plural second conductive patches 1550, 1560, 1570 and 1580, wherein the first antenna array AR1 and the second antenna array AR2 are disposed on the printed circuit board 590. In an embodiment, the antenna structure 1500 may also include a wireless communication circuit 595 that is disposed on the printed circuit board 590 and is electrically connected to the first antenna array AR1 and the second antenna array AR2.

In various embodiments, the printed circuit board 590 may include a first surface 591 facing in a first direction (direction ①) and a second surface 592 facing in a direction opposite to the first surface 591 (direction ②). In an embodiment, the first antenna array AR1 and the second antenna array AR2 may be arranged so as to form a beam pattern in the first direction (direction ①). In an embodiment, the wireless communication circuit 595 may be disposed on the second surface 592 of the printed circuit board 590. In an embodiment, the wireless communication circuit 595 may be disposed spaced apart from the printed circuit board 590 in the internal space of the electronic device, and may be electrically connected to the first antenna array AR1 and/or the second antenna array AR2 through an electrical connection member. In an embodiment, the plural first conductive patches 1510, 1520, 1530 and 1540 and/or the plural second conductive patches 1550, 1560, 1570 and 1580 may be electrically connected to the wireless communication circuit 595. In an embodiment, the wireless communication circuit 595 may be configured to transmit and/or receive a radio frequency signal in the range of about 3 GHz to 100 GHz through the first antenna array AR1 and/or the second antenna array AR2. In an embodiment, the wireless communication circuit 595 may be configured to transmit and/or receive a signal of a first frequency band (e.g., 39 GHz band) through the first antenna array AR1. In an embodiment, the wireless communication circuit 595 may be configured to transmit and/or receive a signal of a second frequency band (e.g., 28 GHz band) lower than the first frequency band through the second antenna array AR2.

In various embodiments, the plural first conductive patches 1510, 1520, 1530 and 1540 may include a first conductive patch 1510, a second conductive patch 1520, a third conductive patch 1530, and a fourth conductive patch 1540 that are arranged at regular intervals on the first side 591 of the printed circuit board 590 or arranged at regular intervals in a region closer to the first surface 591 than the second surface 592 within the printed circuit board 590. In an embodiment, when the first surface 591 is viewed from above, the plural second conductive patches 1550, 1560, 1570 and 1580 may include: a fifth conductive patch 1550 that at least partially overlaps the first conductive patch 1510, has the same center, and is disposed under the corresponding conductive patches; a sixth conductive patch 1560 that at least partially overlaps the second conductive patch 1520, has the same center, and is disposed under the corresponding conductive patches; a seventh conductive patch 1570 that at least partially overlaps the third conductive patch 1530, has the same center, and is disposed under the corresponding conductive patches; or an eighth conductive patch 1580 that at least partially overlaps the fourth conductive patch 1540, has the same center, and is disposed under the corresponding conductive patches. In an embodiment, the plural first conductive patches 1510, 1520, 1530 and 1540 and the plural second conductive patches 1550, 1560, 1570 and 1580 may be disposed on different insulating layers of the printed circuit board 590. In an embodiment, the plural second conductive patches 1550, 1560, 1570 and 1580 may be disposed between the plural first conductive patches 1510, 1520, 1530 and 1540 and the second surface 592 of the printed circuit board. In an embodiment, the plural first conductive patches 1510, 1520, 1530 and 1540 may be formed to be smaller in size than the plural second conductive patches 1550, 1560, 1570 and 1580.

In various embodiments, the plural first conductive patches 1510, 1520, 1530 and 1540 may have substantially the same configuration. In an embodiment, the plural second conductive patches 1550, 1560, 1570 and 1580 may have substantially the same configuration. In an embodiment, the first conductive patch 1510, the second conductive patch 1520, the third conductive patch 1530 and the fourth conductive patch 1540 may have the same arrangement structure as the fifth conductive patch 1550, the sixth conductive patch 1560, the seventh conductive patch 1570 and the eighth conductive patch 1580, respectively. An example embodiment of the present disclosure has shown and described the antenna structure 1500 that includes, as a pair, the first antenna array AR1 including four first conductive patches 1510, 1520, 1530 and 1540 and the second antenna array AR2 including four second conductive patches 1550, 1560, 1570 and 1580. However, the disclosure is not limited thereto. For example, the antenna structure 1500 may include one, two, three, or five or more first conductive patches as a first antenna array AR1 and include one, two, three, or five or more second conductive patches as a second antenna array AR2 where the first conductive patches may be paired with the second conductive patches.

In various embodiments, the antenna structure 1500 may operate as a dual polarized antenna in the first frequency band through the feeding points disposed on each of the plural first conductive patches 1510, 1520, 1530 and 1540. For example, the first conductive patch 1510 may include a first feeding point 1511 and/or a second feeding point 1512. The second conductive patch 1520 may include a third feeding point 1521 and/or a fourth feeding point 1522. The third conductive patch 1530 may include a fifth feeding point 1531 and/or a sixth feeding point 1532. The fourth conductive patch 1540 may include a seventh feeding point 1541 and/or an eighth feeding point 1542. In an embodiment, the antenna structure 1500 may operate as a dual polarized antenna in the second frequency band through feeding points disposed on each of the plural second conductive patches 1550, 1560, 1570 and 1580. For example, the fifth conductive patch 1550 may include a ninth feeding point 1551 and/or a tenth feeding point 1552. The sixth conductive patch 1560 may include an eleventh feeding point 1561 and/or a twelfth feeding point 1562. The seventh conductive patch 1570 may include a thirteenth feeding point 1571 and/or a fourteenth feeding point 1572. The eighth conductive patch 1580 may include a fifteenth feeding point 1581 and/or a sixteenth feeding point 1582. In an embodiment, to form a dual polarized antenna, the plural first conductive patches 1510, 1520, 1530 and 1540 and the plural second conductive patches 1550, 1560, 1570 and 1580 may be formed in an up-down, left-right symmetrical shape. For example, the plural first conductive patches 1510, 1520, 1530 and 1540 and/or the plural second conductive patches 1550, 1560, 1570 and 1580 may be formed in the shape of a square, a circle, or a regular octagon.

In an embodiment, the wireless communication circuit 595 may be configured to transmit and/or receive a first signal of a first polarization in the first frequency band by use of the first feeding point 1511, the third feeding point 1521, the fifth feeding point 1531 and/or the seventh feeding point 1541. In an embodiment, the wireless communication circuit 595 may be configured to transmit and/or receive a second signal of a second polarization in the first frequency band by use of the second feeding point 1512, the fourth feeding point 1522, the sixth feeding point 1532 and/or the eighth feeding point 1542. In an embodiment, the wireless communication circuit 595 may transmit and/or receive the first signal and/or the second signal that are identical or not identical to each other in the first frequency band.

In an embodiment, the wireless communication circuit 595 may be configured to transmit and/or receive a third signal of a third polarization in the second frequency band by use of the ninth feeding point 1551, the eleventh feeding point 1561, the thirteenth feeding point 1571 and/or the fifteenth feeding point 1581. The third polarization may be substantially the same as the first polarization, for example. In an embodiment, the wireless communication circuit 595 may be configured to transmit and/or receive a fourth signal of a fourth polarization in the second frequency band by use of the tenth feeding point 1552, the twelfth feeding point 1562, the fourteenth feeding point 1572 and/or the sixteenth feeding point 1582. The fourth polarization may be substantially the same as the second polarization, for example. In an embodiment, the wireless communication circuit 595 may transmit and/or receive the third signal and/or the fourth signal that are identical or not identical to each other in the second frequency band.

In various embodiments, the first feeding point 1511 may be disposed on a first virtual line L1 passing through the center of the first conductive patch 1510. In an embodiment, the second feeding point 1512 may be disposed on a second virtual line L2 that passes through the center of the first conductive patch 1510, is rotated substantially 90 degrees with respect to the first virtual line L1, and perpendicularly intersects the first virtual line L1. In an embodiment, the ninth feed point 1551 may be disposed on the first virtual line L1 in the fifth conductive patch 1550 when the printed circuit board 590 is viewed from above. In an embodiment, the ninth feeding point 1551 may be disposed on the opposite side of the first feeding point 1511 with respect to the center of the first virtual line L1. In an embodiment, the tenth feeding point 1552 may be disposed on the second virtual line L2 in the fifth conductive patch 1550 when the printed circuit board 590 is viewed from above. In an embodiment, the tenth feeding point 1552 may be disposed on the opposite side of the second feeding point 1512 with respect to the center of the second virtual line L2.

In various embodiments, the configurations of the third feeding point 1521 and the fourth feeding point 1522 of the second conductive patch 1520 may be substantially identical respectively to those of the first feeding point 1511 and the second feeding point 1512 of the first conductive patch 5110. In an embodiment, the configurations of the eleventh feeding point 1561 and the twelfth feeding point 1562 of the sixth conductive patch 1560 may be substantially identical respectively to those of the ninth feeding point 1551 and the tenth feeding point 1552 of the fifth conductive patch 5550.

In various embodiments, the configurations of the fifth feeding point 1531 and the sixth feeding point 1532 of the third conductive patch 1530 may be substantially identical respectively to those of the first feeding point 1511 and the second feeding point 1512 of the first conductive patch 5110. In an embodiment, the configurations of the thirteenth feeding point 1571 and the fourteenth feeding point 1572 of the seventh conductive patch 1570 may be substantially identical respectively to those of the ninth feeding point 1551 and the tenth feeding point 1552 of the fifth conductive patch 5550.

In various embodiments, the configurations of the seventh feeding point 1541 and the eighth feeding point 1542 of the fourth conductive patch 1540 may be substantially identical respectively to those of the first feeding point 1511 and the second feeding point 1512 of the first conductive patch 5110. In an embodiment, the configurations of the fifteenth feeding point 1581 and the sixteenth feeding point 1582 of the eighth conductive patch 1580 may be substantially identical respectively to those of the ninth feeding point 1551 and the tenth feeding point 1552 of the fifth conductive patch 5550.

In various embodiments, the printed circuit board 590 may include a plurality of insulating layers. In an embodiment, the printed circuit board 590 may include a first layer region 5901 including at least one insulating layer, and a second layer region 5902 adjacent to the first layer region 5901 and including at least one other insulating layer. In an embodiment, the first conductive patch 1510 may be disposed on a first insulating layer 5901*a* of the first layer region 5901. In an embodiment, the fifth conductive patch 1550 may be disposed on a second insulating layer 5901*b* of the first layer region 5901 farther than the first conductive patch 1510 from the first surface 591. In an embodiment, the antenna structure 1500 may include at least one ground layer 5903 arranged on at least one third insulating layer 5902*a* of the second layer region 5902. In an embodiment, the at least one ground layer 5903 may be electrically connected to each other in the second layer region 5902 through at least one conductive via 5904.

In various embodiments, the first conductive patch 1510 may be disposed so as to be exposed to the first surface 591 within the first layer region 5901. In an embodiment, the fifth conductive patch 1550 may be disposed on a second insulating layer 5901*b* of the first layer region 5901 farther than the first conductive patch 1510 from the first surface 591. In an embodiment, the first conductive patch 1510 may be disposed to have the same center as the fifth conductive patch 1550 and at least partially overlap the fifth conductive patch 1550 when the first surface 591 is viewed from above. In an embodiment, the first conductive patch 1510 may be disposed to be smaller in size and/or identical in shape compared to the fifth conductive patch 1550 when the first surface 591 is viewed from above.

In various embodiments, the first conductive patch 1510 may include a first feeding point 1511 electrically connected to a first feeding part 1511*a* disposed to penetrate at least the first layer region 5901 in a vertical direction, and/or a second feeding point 1512 electrically connected to a second feeding part 1512*a*. In an embodiment, the first feeding part 1511*a* and the second feeding part 1512*a* may include a conductive via penetrating the first layer region 5901 and electrically connected to the first conductive patch 1510. In an embodiment, the first feeding part 1511*a* may be electrically connected to the wireless communication circuit 595 through a first feed line 590*a* disposed in the second layer region 5902. In an embodiment, the second feeding part 1512*a* may be electrically connected to the wireless communication circuit 595 through a second feed line 590*b* disposed in the second layer region 5902. In an embodiment, the first feed line 590*a* and/or the second feed line 590*b* may be arranged to be electrically disconnected from at least one ground layer 5903 disposed on the third insulating layer 5902*a* of the second layer region 5902.

In various embodiments, the fifth conductive patch 1550 may include a ninth feed point 1551 electrically connected to a ninth feeding part 1551*a* disposed to penetrate at least the first layer region 5901 in a vertical direction, and/or a tenth feed point 1552 electrically connected to a tenth feeding part 1552*a*. In an embodiment, the ninth feeding part 1551*a* and/or the tenth feeding part 1552*a* may include a conductive via penetrating the first layer region 5901 and electrically connected to the fifth conductive patch 1550. In an embodiment, the ninth feeding part 1551*a* may be electrically connected to the wireless communication circuit 595 through a third feed line 590*c* disposed in the second layer region 5902. In an embodiment, the tenth feeding part 1552*a* may be electrically connected to the wireless communication circuit 595 through a fourth feed line 590*d* disposed in the second layer region 5902. In an embodiment, the third feed line 590*c* and/or the fourth feed line 590*d* may be arranged to be electrically disconnected from at least one ground layer 5903 disposed on the third insulating layer 5902*a* of the second layer region 5902.

In various embodiments, the first feeding point 1511 and the second feeding point 1512 may be connected to the first conductive patch 1510 in a direct way or in an indirect way for coupling. In an embodiment, the ninth feeding point 1551*a* and the tenth feeding point 1552*a* may be connected to the fifth conductive patch 1550 in a direct way or in an indirect way for coupling.

In various embodiments, the antenna structure 1500 may provide a vertically and horizontally symmetrical ground condition through the first conductive sidewalls 1514 disposed on the printed circuit board 590 with respect to the first conductive patch 1510 and the fifth conductive patch 1550, so that XPD characteristics may be improved. In an embodiment, the first conductive sidewalls 1514 may be electrically connected to the ground layers 5903. In an embodiment, the first conductive sidewalls 1514 may be disposed to be electrically disconnected from the first conductive patch 1510 and the fifth conductive patch 1550. In an embodiment, isolation characteristics between ports connected respectively to corresponding feeding parts (polarization isolation) and XPD characteristics may have a trade-off relationship according to a change in length d of the first conductive sidewalls 1514. Hence, appropriate adjustment of the length of the first conductive sidewalls 1514 may contribute to both improving the XPD characteristics of the antenna structure 1500 and preventing and/or reducing deterioration of the isolation characteristics between ports.

Figure 17:
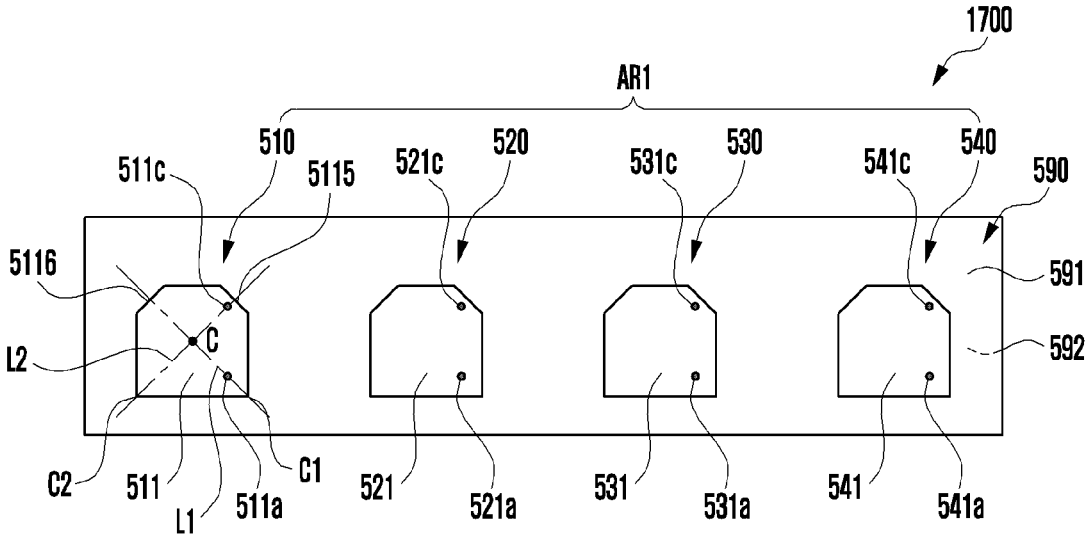
FIG. 17 is a diagram illustrating an example configuration of an antenna structure according to various embodiments.

FIG. 17 is a diagram illustrating an example configuration of an antenna structure 1700 according to various embodiments.

The antenna structure 1700 of FIG. 17 may be at least partially similar to the third antenna module 246 in FIG. 2, or may further include other embodiments of an antenna structure.

The antenna structure 1700 of FIG. 17, as an antenna array AR1, may include a first antenna 510 including a first conductive patch 511, a second antenna 520 including a second conductive patch 521, a third antenna 530 including a third conductive patch 531, or a fourth antenna 540 including a fourth conductive patch 541. In an embodiment, as the first conductive patch 511, the second conductive patch 521, the third conductive patch 531, or the fourth conductive patch 541 has substantially the same configuration as the first conductive patch 511 in FIG. 6B, corresponding components are assigned the same reference numerals and detailed descriptions thereof may not be repeated here.

In various embodiments, the first conductive patch 511 may include a first feeding point 511*a* disposed close to the first corner C1 on a first virtual line L1, and a second feeding point 511*c* disposed close to the fifth side 5115 on a second virtual line L2. In an embodiment, in the first conductive patch 511, the first feeding point may be disposed close to the second corner C2 on the second virtual line L2, and the second feeding point may be disposed close to the sixth side 5116 on the first virtual line L1.

In various embodiments, the first feeding point 511*a* disposed close to the first corner C1 of the first conductive patch 511 may be electrically connected to the wireless communication circuit (e.g., wireless communication circuit 595 in FIG. 5B) through direct feeding. In an embodiment, the second feeding point 511*c* disposed close to the fifth side 5115 of the first conductive patch 511 may be electrically connected to the wireless communication circuit 595 through indirect feeding (e.g., coupled feeding).

In various embodiments, substantially identical to the first conductive patch 511, the second conductive patch 521 may include a third feeding point 521*a* and a fourth feeding point 521*c*, the third conductive patch 531 may include a fifth feeding point 531*a* and a sixth feeding point 531*c*, and the fourth conductive patch 541 may include a seventh feeding point 541*a* and an eighth feeding point 541*c*.

Figure 18:
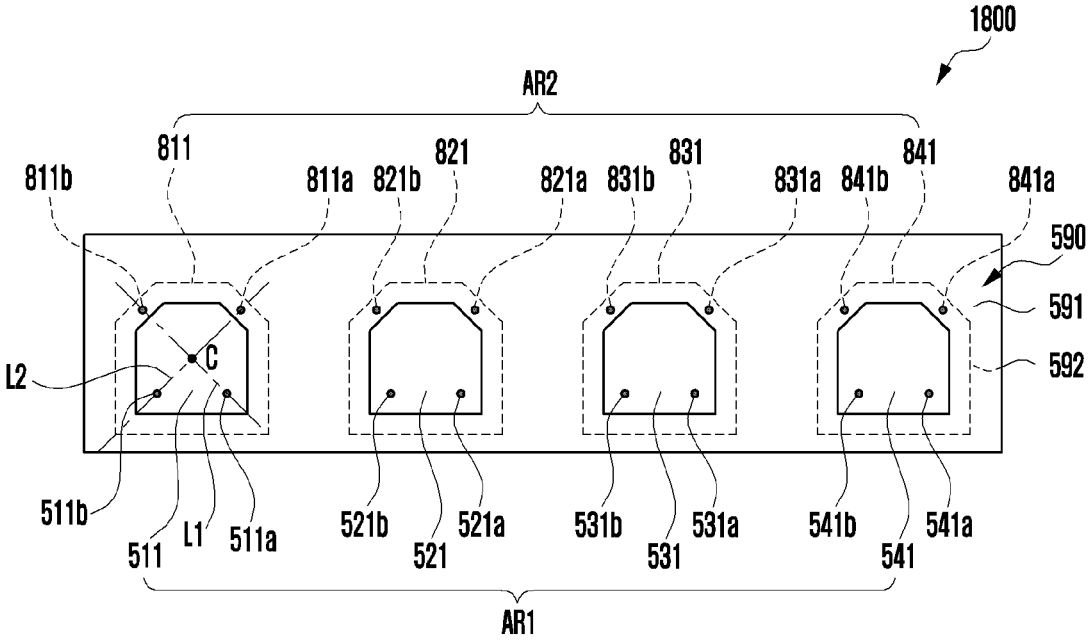
FIG. 18 is a diagram illustrating an example configuration of an antenna structure according to various embodiments.

FIG. 18 is a diagram illustrating an example configuration of an antenna structure 1800 according to various embodiments.

The antenna structure 1800 of FIG. 18 may be at least partially similar to the third antenna module 246 in FIG. 2, or may further include other embodiments of an antenna structure.

With reference to FIG. 18, the antenna structure 1800 may include a printed circuit board 590, a first antenna array AR1 including plural first conductive patches 511, 521, 531 and 541, and/or a second antenna array AR2 including plural second conductive patches 811, 821, 831 and 841, wherein the first antenna array AR1 and the second antenna array AR2 are disposed on the printed circuit board 590. In an embodiment, the antenna structure 1800 may also include a wireless communication circuit (e.g., wireless communication module 192 in FIG. 1) that is disposed on the printed circuit board 590 and is electrically connected to the first antenna array AR1 and the second antenna array AR2. In an embodiment, the wireless communication circuit (e.g., wireless communication module 192 in FIG. 1) may be configured to transmit and/or receive a signal of a first frequency band (e.g., about 39 GHz band) through the first antenna array AR1. In an embodiment, the wireless communication circuit 595 may be configured to transmit and/or receive a signal of a second frequency band (e.g., 28 GHz band) lower than the first frequency band through the second antenna array AR2.

In various embodiments, the plural first conductive patches 511, 521, 531 and 541 may include a first conductive patch 511, a second conductive patch 521, a third conductive patch 531, and a fourth conductive patch 541 that are arranged at regular intervals on the first side 591 of the printed circuit board 590 or arranged at regular intervals in a region closer to the first surface 591 than the second surface 592 within the printed circuit board 590. In an embodiment, when the first surface 591 is viewed from above, the plural second conductive patches 811, 821, 831 and 841 may include: a fifth conductive patch 811 that at least partially overlaps the first conductive patch 511, has the same center, and is disposed thereunder; a sixth conductive patch 821 that at least partially overlaps the second conductive patch 521, has the same center, and is disposed thereunder; a seventh conductive patch 831 that at least partially overlaps the third conductive patch 531, has the same center, and is disposed thereunder; or an eighth conductive patch 841 that at least partially overlaps the fourth conductive patch 541, has the same center, and is disposed thereunder. In an embodiment, the plural first conductive patches 511, 521, 531 and 541 and the plural second conductive patches 811, 821, 831 and 841 may be disposed on different insulating layers of the printed circuit board 590. In an embodiment, the plural first conductive patches 511, 521, 531 and 541 may be formed to be smaller in size than the plural second conductive patches 811, 821, 831 and 841. In an embodiment, the plural first conductive patches 511, 521, 531 and 541 and the plural second conductive patches 811, 821, 831 and 841 may each have a shape substantially identical to that of the first conductive patch 511 in FIG. 6B.

In various embodiments, the antenna structure 1800 may operate as a dual polarized antenna in the first frequency band through the feeding points disposed on the plural first conductive patches 511, 521, 531 and 541. For example, the first conductive patch 511 may include a first feeding point 511*a* and/or a second feeding point 511*b*. The second conductive patch 521 may include a third feeding point 521*a* and/or a fourth feeding point 521*b*. The third conductive patch 531 may include a fifth feeding point 531*a* and/or a sixth feeding point 531*b*. The fourth conductive patch 541 may include a seventh feeding point 541*a* and/or an eighth feeding point 541*b*. In an embodiment, the antenna structure 1800 may operate as a dual polarized antenna in the second frequency band through the feeding points disposed on the plural second conductive patches 811, 821, 831 and 841. For example, the fifth conductive patch 811 may include a ninth feeding point 811*a* and/or a tenth feeding point 811*b*. The sixth conductive patch 821 may include an eleventh feeding point 821*a* and/or a twelfth feeding point 821*b*. The seventh conductive patch 831 may include a thirteenth feeding point 831*a* and/or a fourteenth feeding point 831*b*. The eighth conductive patch 841 may include a fifteenth feeding point 841*a* and/or a sixteenth feeding point 841*b*.

In an embodiment, the wireless communication circuit (e.g., wireless communication module 192 in FIG. 1) may be configured to transmit and/or receive a first signal of a first polarization in the first frequency band by use of the first feeding point 511*a*, the third feeding point 521*a*, the fifth feeding point 531*a* and/or the seventh feeding point 541*a*. In an embodiment, the wireless communication circuit (e.g., wireless communication module 192 in FIG. 1) may be configured to transmit and/or receive a second signal of a second polarization in the first frequency band by use of the second feeding point 511*b*, the fourth feeding point 521*b*, the sixth feeding point 531*b* and/or the eighth feeding point 541*b*. In an embodiment, the wireless communication circuit (e.g., wireless communication module 192 in FIG. 1) may transmit and/or receive the first signal and/or the second signal that are identical or not identical to each other in the first frequency band.

In an embodiment, the wireless communication circuit (e.g., wireless communication module 192 in FIG. 1) may be configured to transmit and/or receive a third signal of a third polarization identical to the first polarization in the second frequency band by use of the ninth feeding point 811*a*, the eleventh feeding point 821*a*, the thirteenth feeding point 831*a* and/or the fifteenth feeding point 841*a*. In an embodiment, the wireless communication circuit (e.g., wireless communication module 192 in FIG. 1) may be configured to transmit and/or receive a fourth signal of a fourth polarization identical to the second polarization in the second frequency band by use of the tenth feeding point 811*b*, the twelfth feeding point 821*b*, the fourteenth feeding point 831*b* and/or the sixteenth feeding point 841*b*. In an embodiment, the wireless communication circuit (e.g., wireless communication module 192 in FIG. 1) may transmit and/or receive the third signal and/or the fourth signal that are identical or not identical to each other in the second frequency band.

In various embodiments, the first feeding point 511*a* may be disposed on a first virtual line L1 passing through the center C of the first conductive patch 511. In an embodiment, the second feeding point 511*b* may be disposed on a second virtual line L2. In an embodiment, the ninth feeding point 811*a* may be disposed on the second virtual line L2 passing through the center C of the fifth conductive patch 811. In an embodiment, the tenth feeding point 811*b* may be disposed on the first virtual line L1. In an embodiment, the feeding points 521*a* and 521*b* of the second conductive patch 521, the feeding points 531*a* and 531*b* of the third conductive patch 531, or the feeding points 541*a* and 541*b* of the fourth conductive patch 541 may be arranged in a manner substantially the same manner as that of the feeding points 511*a* and

511*b* of the first conductive patch 511. In an embodiment, the feeding points 821*a* and 821*b* of the sixth conductive patch 821, the feeding points 831*a* and 831*b* of the seventh conductive patch 831, or the feeding points 841*a* and 841*b* of the eighth conductive patch 841 may be arranged in a manner substantially the same as that of the feeding points 811*a* and 811*b* of the fifth conductive patch 811. In an embodiment, the feeding points 511*a* and 511*b* of the first conductive patch 511, the feeding points 521*a* and 521*b* of the second conductive patch 521, the feeding points 531*a* and 531*b* of the third conductive patch 531, or the feeding points 541*a* and 541*b* of the fourth conductive patch 541 may be directly fed with the wireless communication circuit. In an embodiment, the feeding points 811*a* and 811*b* of the fifth conductive patch 811, the feeding points 821*a* and 821*b* of the sixth conductive patch 821, the feeding points 831*a* and 831*b* of the seventh conductive patch 831, or the feeding points 841*a* and 841*b* of the eighth conductive patch 841 may be connected to the wireless communication circuit through indirect feeding (capacitively coupled).

In an embodiment, the antenna structure 1800 may further include conductive sidewalls (e.g., conductive sidewalls 514*a* and 514*b* in FIG. 13) disposed close to each of the conductive patches 811, 821, 831 and 841 of the second antenna array AR2 when the first surface of the printed circuit board 590 is viewed from above. In an embodiment, the XPD characteristics of the antenna structure 1800 may be determined by adjusting the length of the conductive sidewalls.

According to various example embodiments of the disclosure, it is possible to effectively suppress cross polarization and improve the XPD characteristic for a high level cross polarization discrimination by changing a part of the shape of the conductive patch, contributing to improving the radiation performance of the antenna.

According to various example embodiments, an electronic device (e.g., electronic device 300 of FIG. 3A) may include: a housing (e.g., housing 310 in FIG. 3A); and an antenna structure (e.g., antenna structure 500 in FIG. 5A) disposed in the internal space of the housing, wherein the antenna structure may include: a printed circuit board (e.g., printed circuit board 590 in FIG. 5A) including a plurality of insulating layers; and at least one first conductive patch (e.g., first conductive patch 511 in FIG. 5A) disposed on the printed circuit board, wherein the at least one first conductive patch may comprise: a first side (e.g., first side 5111 in FIG. 6B) having a first length; a second side (e.g., second side 5112 in FIG. 6B) parallel to the first side, spaced apart in a direction perpendicular to the first side by a vertical distance, and having a second length shorter than the first length; a third side (e.g., third side 5113 in FIG. 6B) extending from one end of the first side in the direction perpendicular to the first side and having a third length shorter than the vertical distance between the first side and the second side; a fourth side (e.g., fourth side 5114 in FIG. 6B) extending from an other end of the first side in the direction perpendicular to the first side and having the third length; a fifth side (e.g., fifth side 5115 in FIG. 6B) connecting the third side and one end of the second side in a straight line; a sixth side (e.g., sixth side 5116 in FIG. 6B) connecting the fourth side and an other end of the second side in a straight line; a first feeding point (e.g., first feeding point 511*a* in FIG. 6B) disposed on a first virtual line (e.g., first virtual line L1 in FIG. 6B) passing through the center (e.g., center C in FIG. 6B) in the at least one first conductive patch, and configured to transmit and/or receive a first signal of a first polarization; and a second feeding point (e.g., second feeding point 511*b* in FIG. 6B) disposed on a second virtual line (e.g., second virtual line L2 in FIG. 6B) passing through the center in the at least one first conductive patch and intersecting the first virtual line at a right angle, and configured to transmit and/or receive a second signal of a second polarization perpendicular to the first polarization.

In various example embodiments, the electronic device may include a wireless communication circuit (e.g., wireless communication circuit 595 in FIG. 5A) disposed in the internal space and configured to transmit and/or receive a radio signal in a range of about 3 GHz to 100 GHz through the first feeding point and the second feeding point.

In various example embodiments, the wireless communication circuit may be disposed on the printed circuit board.

In various example embodiments, the first feeding point may be directly electrically connected to the wireless communication circuit through the printed circuit board.

In various example embodiments, the second feeding point may be directly electrically connected to the wireless communication circuit through the printed circuit board.

In various example embodiments, the first feeding point may be disposed closer to a first corner (e.g., first corner C1 in FIG. 6B) formed by the first side and the third side in the at least one first conductive patch than a center of the first conductive patch.

In various example embodiments, the second feeding point may be disposed closer to a second corner (e.g., second corner C2 in FIG. 6B) formed by the first side and the fourth side in the at least one first conductive patch than a center of the first conductive patch.

In various example embodiments, the second feeding point may be disposed between the center and the fifth side on the second virtual line.

In various example embodiments, the electronic device may further include a wireless communication circuit disposed on the printed circuit board, and the second feeding point may be indirectly electrically connected to the wireless communication circuit through the printed circuit board (e.g., capacitively coupled).

In various example embodiments, a cross-polarization discrimination (XPD) characteristic of the antenna structure may be determined based on the vertical distance (e.g., vertical distance h in FIG. 6B) from the corner where the second side and the extension line of the third side intersect to the fifth side.

In various example embodiments, the cross-polarization discrimination (XPD) characteristic of the antenna structure may be determined based on the vertical distance (e.g., vertical distance h in FIG. 6B) from the corner where the second side and the extension line of the fourth side intersect to the sixth side.

In various example embodiments, the electronic device may include second conductive patches (e.g., second conductive patches 512 in FIG. 5B) surrounding a first region (e.g., first region 5101 in FIG. 5B) where the at least one first conductive patch is disposed and are disposed in a square-shaped second region (e.g., second region 5102 in FIG. 5B).

In various example embodiments, the printed circuit board may include a first surface facing in a first direction and a second surface facing in a second direction opposite to the first direction. The at least one first conductive patch may be disposed on a first insulating layer among plural insulating layers, and the second conductive patches may be disposed on a second insulating layer closer to the first surface than the first insulating layer or on the first surface.

In various example embodiments, the electronic device may further include at least one conductive wall (e.g., conductive walls 513 in FIG. 7) disposed at least one of four corners of the second region and electrically connected to a ground layer (e.g., ground layer 5903 in FIG. 7) of the printed circuit board.

In various example embodiments, the at least one conductive wall may be coupled to the plural second conductive patches.

In various example embodiments, the electronic device may include conductive sidewalls (e.g., conductive sidewalls 514*a* and 514*b* in FIG. 13) of a preset length disposed at four corners of the second region.

In various example embodiments, the XPD characteristic of the antenna structure may be determined by the length (e.g., length d in FIG. 13) of the conductive sidewalls.

In various example embodiments, the housing (e.g., housing 910 in FIG. 10A) may include: a front plate (e.g., front cover 930 in FIG. 10A) facing in a first direction; a rear plate (e.g., rear cover 940 in FIG. 10A) facing in a direction opposite the front plate; and a side wall (e.g., side member 920 in FIG. 10A) surrounding the internal space (e.g., internal space 9001 in FIG. 10A) between the front plate and the rear plate, wherein the side wall may include a conductive portion (e.g., conductive portion 921 in FIG. 10A) and a non-conductive portion (e.g., non-conductive portion 922 in FIG. 10A) at least partially coupled to the conductive portion.

In various example embodiments, the printed circuit board may be arranged to form a beam pattern toward the non-conductive portion at a position where the at least one first conductive patch faces the non-conductive portion.

In various example embodiments, the electronic device may include a display (e.g., display 931 in FIG. 10A) disposed in the internal space to be at least partially visible from the outside through the front plate.

While the disclosure has been illustrated and described with reference to various example embodiments, it will be understood that the various example embodiments are intended to be illustrative, not limiting. It will be further understood by those skilled in the art that many changes in form and detail may be made without departing from the true spirit and full scope of the disclosure, including the appended claims and their equivalents.

What is claimed is:

1. An electronic device comprising:

a housing; and an antenna structure disposed in an internal space of the housing, wherein the antenna structure includes:

a printed circuit board including a plurality of insulating layers; and at least one first conductive patch disposed on the printed circuit board, wherein the at least one first conductive patch includes:

a first side having a first length;

a second side parallel to the first side, spaced apart in a direction perpendicular to the first side, and having a second length shorter than the first length;

a third side extending from one end of the first side in a direction perpendicular to the first side, and having a third length shorter than a vertical distance between the first side and the second side;

a fourth side extending from an other end of the first side in a direction perpendicular to the first side, and having the third length;

a fifth side connecting the third side and one end of the second side in a straight line;

a sixth side connecting the fourth side and an other end of the second side in a straight line;

a first feeding point disposed on a first virtual line passing through a center of the at least one first conductive patch and configured to transmit and/or receive a first signal of a first polarization; and a second feeding point disposed on a second virtual line passing through the center of the at least one first conductive patch and intersecting the first virtual line at a right angle and configured to transmit and/or receive a second signal of a second polarization perpendicular to the first polarization.

2. The electronic device of claim 1, further comprising a wireless communication circuit disposed in the internal space and configured to transmit and/or receive a radio signal in a range of about 3 GHz to 100 GHz through the first feeding point and the second feeding point.

3. The electronic device of claim 2, wherein the wireless communication circuit is disposed on the printed circuit board.

4. The electronic device of claim 3, wherein the first feeding point is directly electrically connected to the wireless communication circuit through the printed circuit board.

5. The electronic device of claim 3, wherein the second feeding point is directly electrically connected to the wireless communication circuit through the printed circuit board.

6. The electronic device of claim 1, wherein the first feeding point is disposed closer to a first corner formed by the first side and the third side in the at least one first conductive patch than the center of the at least one first conductive patch.

7. The electronic device of claim 1, wherein the second feeding point is disposed closer to a second corner formed by the first side and the fourth side in the at least one first conductive patch than the center of the at least one first conductive patch.

8. The electronic device of claim 1, wherein the second feeding point is disposed between the center and the fifth side on the second virtual line.

9. The electronic device of claim 8, further comprising a wireless communication circuit disposed on the printed circuit board, wherein the second feeding point is capacitively coupled to the wireless communication circuit through the printed circuit board.

10. The electronic device of claim 1, wherein a cross-polarization discrimination (XPD) characteristic of the antenna structure is based on a vertical distance from a corner where the second side and an extension line of the third side intersect to the fifth side.

11. The electronic device of claim 1, wherein a cross-polarization discrimination (XPD) characteristic of the antenna structure is based on a vertical distance from a corner where the second side and an extension line of the fourth side intersect to the sixth side.

12. The electronic device of claim 1, further comprising plural second conductive patches surrounding a first region where the at least one first conductive patch is disposed and disposed in a square-shaped second region.

13. The electronic device of claim 12, wherein:

the printed circuit board includes a first surface facing a first direction and a second surface facing a second direction opposite the first direction;

the at least one first conductive patch being disposed on a first insulating layer among the plural insulating layers; and the second conductive patches being disposed on a second insulating layer closer to the first surface than the first insulating layer or on the first surface.

14. The electronic device of claim 12, further comprising at least one conductive wall disposed at least one of four corners of the second region and electrically connected to a ground layer of the printed circuit board.

15. The electronic device of claim 14, wherein the at least one conductive wall is coupled to the plural second conductive patches.

16. The electronic device of claim 14, further comprising conductive sidewalls having a preset length disposed at four corners of the second region.

17. The electronic device of claim 16, wherein a cross-polarization discrimination (XPD) characteristic of the antenna structure is based on a length of the conductive sidewalls.

18. The electronic device of claim 1, wherein:

the housing includes a front plate facing a first direction, a rear plate facing a direction opposite the front plate, and a side member surrounding an internal space between the front plate and the rear plate; and the side member includes a conductive portion, and a non-conductive portion at least partially coupled to the conductive portion.

19. The electronic device of claim 18, wherein the printed circuit board is configured to form a beam pattern toward the non-conductive portion at a position where the at least one first conductive patch faces the non-conductive portion.

20. The electronic device of claim 18, further comprising a display disposed in the internal space to be at least partially visible from an outside through the front plate.

* * * * *